US011014382B2

(12) United States Patent
Asaoka

(10) Patent No.: US 11,014,382 B2
(45) Date of Patent: May 25, 2021

(54) IMAGE FORMING APPARATUS, BASIS-WEIGHT DERIVING METHOD, AND BASIS-WEIGHT DERIVING PROGRAM

(71) Applicant: KONICA MINOLTA, INC., Tokyo (JP)

(72) Inventor: Shogo Asaoka, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/598,488

(22) Filed: Oct. 10, 2019

(65) Prior Publication Data

US 2020/0122482 A1 Apr. 23, 2020

(30) Foreign Application Priority Data

Oct. 18, 2018 (JP) ..... JP2018-196709

(51) Int. Cl.

| | |
|---|---|
| ***B41J 11/00*** | (2006.01) |
| ***G03G 15/00*** | (2006.01) |
| ***B41J 2/447*** | (2006.01) |
| ***B41J 11/20*** | (2006.01) |
| ***G03G 15/04*** | (2006.01) |

(52) U.S. Cl.

CPC ..... *B41J 11/009* (2013.01); *B41J 2/447* (2013.01); *B41J 11/20* (2013.01); *G03G 15/04045* (2013.01); *G03G 15/5029* (2013.01)

(58) Field of Classification Search

CPC ..... B41J 11/009; G03G 15/5029

See application file for complete search history.

(56) References Cited

U.S. PATENT DOCUMENTS

2018/0314199 A1* 11/2018 Matsuda ..... G03G 15/6558
2019/0265607 A1* 8/2019 Ishimoto ..... G03G 15/5062

FOREIGN PATENT DOCUMENTS

| | | | |
|---|---|---|---|
| JP | 2005070508 | A | 3/2005 |
| JP | 2005315856 | A | 11/2005 |
| JP | 2014025864 | A | 2/2014 |
| JP | 2018072129 | A | 5/2018 |

* cited by examiner

*Primary Examiner* — Matthew Luu
*Assistant Examiner* — Kendrick X Liu
(74) *Attorney, Agent, or Firm* — Buchanan Ingersoll & Rooney PC

(57) ABSTRACT

An image forming apparatus includes a first light source, a second light source, an optical sensor, a storage, and a hardware processor, wherein the storage stores a first threshold for determining a type of the recording material based on the basis weight, and the hardware processor calculates a first transmittance from the mount of the first emission light and the amount of the first transmission light, calculates a second transmittance from the amount of the second emission light and the amount of the second transmission light, derives a first basis weight corresponding to the first transmittance and a second basis weight corresponding to the second transmittance, by using predetermined determination criteria, determines the type of the recording material based on the first basis weight and the second basis weight, and derives the basis weight according to the determination criteria based on the determined type of the recording material.

15 Claims, 22 Drawing Sheets

IMAGE FORMING APPARATUS, BASIS-WEIGHT DERIVING METHOD, AND BASIS-WEIGHT DERIVING PROGRAM

The entire disclosure of Japanese patent Application No. 2018-196709, filed on Oct. 18, 2018, is incorporated herein by reference in its entirety.

BACKGROUND

Technological Field

The present disclosure relates to an image forming apparatus, and more particularly to control which is performed on the basis of the type of a recording material in the image forming apparatus.

Description of the Related Art

Image forming apparatuses perform printing on various recording materials including plain paper and the like. The image forming apparatuses are each configured to receive settings of printing conditions including the types of the recording materials according to the user's operation through an operation panel or the like. Different types of the recording materials require different optimum temperatures of a fuser to fuse toner images to the recording materials. In a case where the type of a recording material set as a printing condition is different from the type of a recording material used for printing, the fuser does not have an optimum temperature for the type of the recording material used for printing. When the temperature of the fuser does not reach the optimum temperature, the image forming apparatus cannot sufficiently fuse a toner image to the recording material, and the recording material may have reduced image quality or the like.

Therefore, for example, JP 2018-72129 A discloses a technology that "includes: a light emitting element; an optical sensor including a transmission light reception sensor that detects an amount of transmission light transmitted through a medium, a direct reflection light reception sensor that detects an amount of reflection light directly reflected from the medium, and a scattered/reflected light reception sensor that detects an amount of light scattered/reflected from the medium, and a thickness determination unit that determines a basis weight or thickness of the medium in which the amount of transmission light is normalized on the basis of the amount of light scattered/reflected to calculate a corrected amount of transmission light, the amount of reflection light directly reflected is normalized on the basis of the amount of light scattered/reflected to calculate a corrected amount of light reflected, the corrected amount of light transmitted is added to the corrected amount of light reflected to calculate a thickness coefficient, and the thickness coefficient is used to determine the basis weight or thickness of the medium" (see Abstract).

Furthermore, for example, JP 2005-70508 A discloses a technology that "includes a light emitting element that emits light to a sheet at a position immediately in front of a registration roller in a paper feed path, a transmission light reception element that receives the light emitted to and transmitted through a medium and a reflection light reception element that receives the light emitted to and reflected from the medium, in which reception of the emission light, transmission light, and reflection light are detected (steps S2 and S3), a characteristic of the medium (thickness of the medium) is determined on the basis of detection signals from the transmission light reception element and the reflection light reception element obtained from the detection (step S5), and predetermined control is performed by this image forming apparatus on the basis of a result of the determination (step S6), specifically, controlling a transfer device, a fusing device, or the like according to the thickness of the medium" (see "Abstract").

Incidentally, each of the image forming apparatuses sets a printing condition by using a basis weight (g/m$^2$) which has a value indicating a characteristic of a recording material S. The basis weight is a value indicating the weight per unit area of the recording material. The image forming apparatus acquires, from an optical sensor, an amount of transmission light obtained when emission light emitted to a paper feed path for feeding the recording material is transmitted through the recording material. For example, the emission light is emitted from a light source provided in the vicinity of the paper feed path. The image forming apparatus derives the basis weight of the recording material from a transmittance obtained on the basis of the amount of transmission light. The image forming apparatus derives the basis weight corresponding to the transmittance by using a determination criterion in which a transmittance and a basis weight are associated with each other. Here, even if an identical transmittance is calculated by the image forming apparatus, different basis weights are derived from the transmittance according to the type of the recording material. More specifically, when the image forming apparatus uses a determination criterion used for a type (e.g., coated paper) of a recording material to derive the basis weight of another type (e.g., plain paper) of a recording material, the derived basis weight is different from an actual basis weight of the recording material. Thus, the image forming apparatus sometimes cannot set a printing condition suitable for the recording material. Therefore, it has been required to accurately determine the type of a recording material to derive the basis weight.

SUMMARY

The present disclosure has been made in view of such actual situation and provides a technology for accurately determining the type of a recording material to derive a basis weight according to one aspect.

To achieve the abovementioned object, according to an aspect of the present invention, an image forming apparatus reflecting one aspect of the present invention comprises a first light source that emits first emission light having a first wavelength toward a paper feed path for transporting a recording material in the image forming apparatus, a second light source that emits, toward the paper feed path, second emission light having a second wavelength different in length from the first wavelength, an optical sensor that detects an amount of the first emission light and an amount of the second emission light, an amount of first transmission light obtained when the first emission light is transmitted through the recording material, and an amount of second transmission light obtained when the second emission light is transmitted through the recording material, a storage that stores a plurality of determination criteria each representing a correspondence of a transmittance calculated from an amount of emission light and an amount of transmission light with a basis weight indicating a weight per unit area of the recording material, and a hardware processor that controls operation of the image forming apparatus, wherein the storage stores a first threshold for determining a type of the recording material based on the basis weight, and the hardware processor calculates a first transmittance from the mount of the first emission light and the amount of the first transmission light, calculates a second transmittance from the amount of the second emission light and the amount of the second transmission light, derives a first basis weight corresponding to the first transmittance and a second basis weight corresponding to the second transmittance, by using predetermined determination criteria of the plurality of determination criteria, determines the type of the recording material based on the first basis weight and the second basis weight by using the first threshold, and derives the basis weight according to the determination criteria based on the determined type of the recording material.

BRIEF DESCRIPTION OF THE DRAWINGS

The objects, advantages, aspects, and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
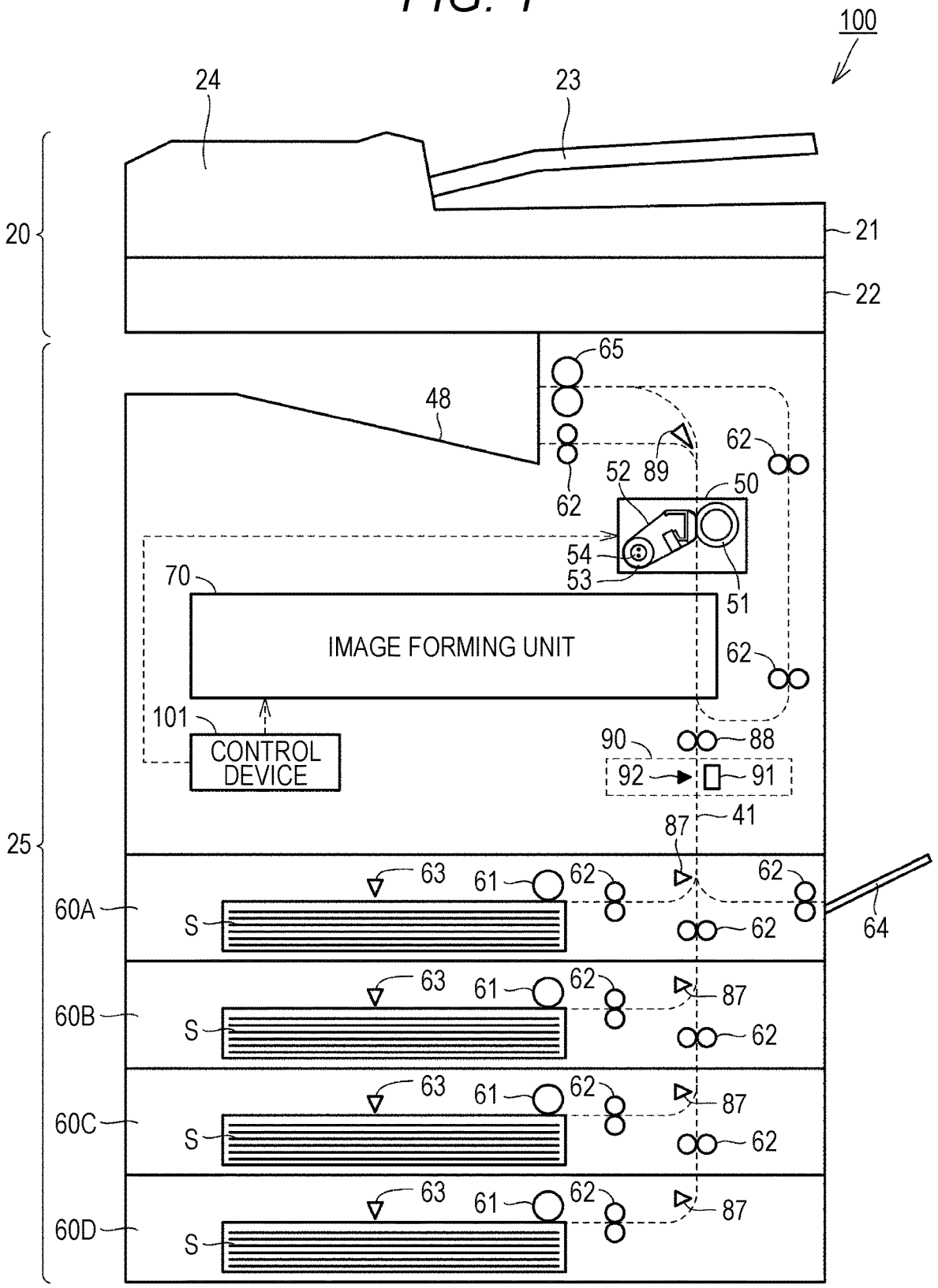
FIG. 1 is a diagram illustrating an example of an internal structure of an image forming apparatus.

Hereinafter, one or more embodiments of the present invention will be described with reference to the drawings. However, the scope of the invention is not limited to the disclosed embodiments. In the following description, the same components are denoted by the same reference numerals. The same components have the same names and functions. Therefore, detailed description thereof will not be repeated.

First Embodiment

[Internal Structure of Image Forming Apparatus 100]

FIG. 1 is a diagram illustrating an example of an internal structure of an image forming apparatus 100. The image forming apparatus 100 may be a color printer, a monochrome printer, or a facsimile or may be a combined machine (so-called multi functional peripheral (MFP)) of a monochrome printer, a color printer, and a facsimile.

The image forming apparatus 100 includes a scanner 20 as an image reader and a printer 25 as an image printer. The scanner 20 includes a cover 21, a platen 22, a paper tray 23, and an auto document feeder (ADF) 24. The cover 21 has one end which is fixed to the platen 22. The cover 21 is configured to be openable and closable with the one end as a fulcrum.

The printer 25 includes storage units 60A to 60D that stores recording materials S, a plurality of paper feed rollers 61 that feeds a recording material S, a plurality of transport rollers 62 that transports the recording material S, a plurality of sensors 63, a timing sensor 87, a timing roller 88, a switching claw 89, and a reverse roller 65.

The printer 25 includes a light amount detector 90 that detects an amount of transmission light transmitted through the recording material S, a control device 101 that controls the operation of the image forming apparatus 100, an image forming unit 70 that forms a toner image and transfer the toner image to the recording material S. and a fuser 50 that fuses the transferred image to the recording material S.

Each of the storage units 60A to 60D has a cassette that sets the recording materials S therein. Hereinafter, the storage units 60A to 60D will be collectively referred to as a storage unit 60. The storage unit 60 is configured to be removable from the image forming apparatus 100. The user can remove the storage unit 60 from the image forming apparatus 100 to set the recording materials S in the storage unit 60. The type of the recording material S to be stored includes, for example, plain paper, coated paper, recycled paper, and the like. The plain paper is, for example, paper made from pulp but is not limited thereto. The plain paper has a surface which is not processed. On the other hand, the coated paper is, for example, paper having a surface which is coated with a coating material but is not limited thereto. The coated paper is used for a catalog or the like. The recycled paper is, for example, paper made from used plain paper but is not limited thereto. Note that the recording material S to be set is not limited to the above-described type and may be another type.

The paper feed rollers 61 are connected to a motor (not illustrated) via a paper feed clutch (not illustrated). The motor is controlled by the control device 101. The control device 101 drives the motor in response to receiving a print instruction from the user. The motor rotates the paper feed rollers 61 via the paper feed clutch. The recording materials S are fed one by one from the storage unit 60 to a paper feed path 41 by the rotation of the paper feed roller 61.

The plurality of transport rollers 62 is provided in the paper feed path 41. The transport rollers 62 are connected to a motor (not illustrated). The transport rollers 62 are rotated by driving the motor by the control device 101. The rotation of the transport rollers 62 transports the recording material S to the light amount detector 90 through the paper feed path 41 positioned in the vicinity of the timing sensor 87. The recording material S having been transported to the light amount detector 90 is transported to the timing roller 88 through the paper feed path 41.

A manual paper feed tray 64 is a tray into which the recording material S for manual feeding is set. The user can set, in the manual paper feed tray 64, the recording material S of non-standard size having a shape other than a rectangular shape, in addition to the recording material S of standard size having the rectangular shape or the like.

When the timing sensor 87 detects the recording material S, the control device 101 adjusts the rotational speed of the timing roller 88 so that the toner image is transferred to a predetermined position of the recording material S. The toner image is formed by the image forming unit 70. More specifically, the control device 101 adjusts timing at which the recording material S is transported from the timing roller 88 to the image forming unit 70. The adjustment of the timing by the control device 101 transfers the toner image to an appropriate position of the recording material S.

The recording material S to which the toner image has been transferred is transported to the fuser 50. The fuser 50 includes a pressure roller 51, an endless fusing belt 52, a heat roller 53, and a heater 54. The pressure roller 51 presses the recording material S passing through between the pressure roller 51 and the fusing belt 52. The fusing belt 52 is positioned around the heat roller 53, and the heat of the heat roller 53 fuses the toner image to the recording material S.

The heat roller 53 includes the heater 54. The control device 101 sets the temperature of the heater 54 to a temperature according to the type of the recording material S. For example, in a case where the type of the recording material S is coated paper, the control device 101 raises the temperature of the heater 54 as compared with a case where the type of the recording material S is plain paper. The image forming apparatus 100 accurately fuses the toner image even though the recording material S is different in type.

The control device 101 may set the rotational speed of the heat roller 53 according to the type of the recording material S. For example, in a case where the type of the recording material S is coated paper, the control device 101 reduces the rotational speed of the heat roller 53 as compared with a case where the type of the recording material S is plain paper. Even when a coating material is applied to a surface of the recording material S to which the toner image is to be fused, a time until the recording material S passes through the fuser 50 is increased, and thus, the image forming apparatus 100 accurately fuses the toner image to the surface of the recording material S.

When receiving an instruction for printing on a single side, the control device 101 discharges the recording material S to which the toner image is fused to the tray 48. When receiving an instruction for instruction for printing on both sides, the control device 101 drives the switching claw 89 to transport the recording material S to which the toner image is fused to the reverse roller 65. The recording material S is transported from the reverse roller 65 to the transport rollers 62 and passes through the image forming unit 70 again. A toner image is fused to a surface of the recording material S opposite to the surface to which the toner image has been fused, and the recording material S to which the toner images are fused on both sides is discharged to the tray 48.

The light amount detector 90 calculates a transmittance of the recording material S which is used to derive the basis weight of the recording material S. The basis weight ($g/m^2$) is a value indicating the weight per unit area of the recording material S. The light amount detector 90 includes a light source 91 and an optical sensor 92. The light source 91 emits emission light having a wavelength. As the light source 91, for example, a light emitting diode (LED) or a laser can be used. As the optical sensor 92, for example, a photodiode or a charge coupled device (CCD) can be used. The optical sensor 92 receives the emission light emitted from the light source 91 to detect an amount of the emission light. The optical sensor 92 also detects an amount of transmission light obtained when emission light emitted from the light source 91 is transmitted through the recording material S.

The control device 101 calculates the transmittance from the amount of emission light and the amount of transmission light which are detected by the optical sensor 92. More specifically, the control device 101 calculates the transmittance by dividing the amount of transmission light by the amount of emission light.

[Hardware Configuration of Image Forming Apparatus 100]

Figure 2:
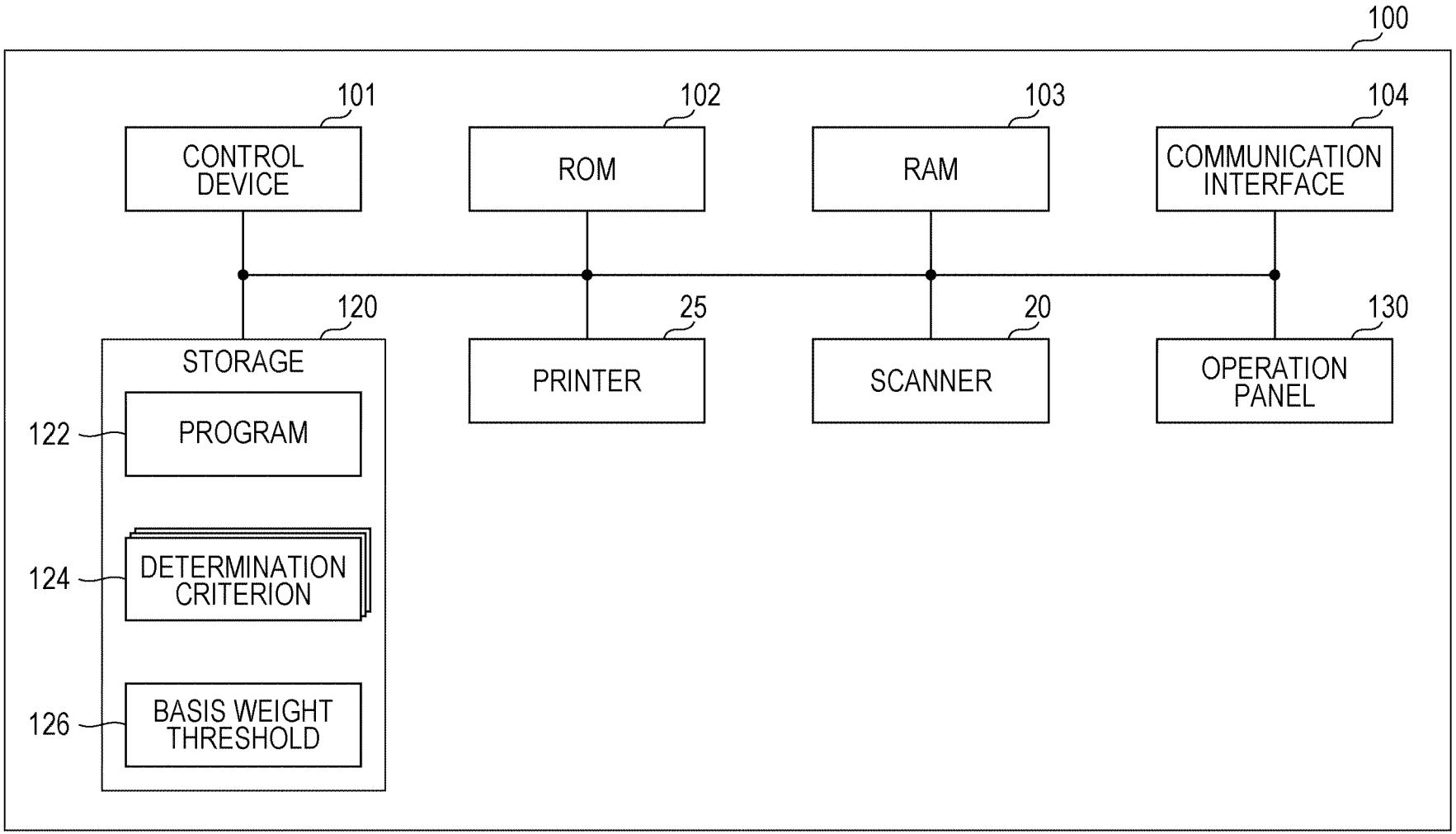
FIG. 2 is a block diagram illustrating a hardware configuration of the image forming apparatus.

FIG. 2 is a block diagram illustrating a hardware configuration of the image forming apparatus 100. As illustrated in FIG. 2, the image forming apparatus 100 includes the control device 101, a read only memory (ROM) 102, a random access memory (RAM) 103, a communication interface 104, an operation panel 130, the scanner 20, the printer 25, and a storage 120.

The control device 101 includes, for example, at least one integrated circuit. The integrated circuit includes, for example, at least one central processing unit (CPU), at least one application specific integrated circuit (ASIC), at least one field programmable gate array (FPGA), or a combination thereof. The control device 101 executes various programs, such as a control program 122 according to the present embodiment to control the operation of the image forming apparatus 100. The control device 101 reads the control program 122 from the storage 120 to the RAM 103 on the basis of reception of an instruction to execute the control program 122. The RAM 103 functions as a working memory and temporarily stores various data required for execution of the control program 122. In response to execution of the control program 122, the control device 101 controls, on the basis of a printing condition, the scanner 20 functioning as the image reader and the printer 25 functioning as the image printer to perform print on the recording material S.

An antenna (not illustrated) or the like is connected to the communication interface 104. The image forming apparatus 100 transmits and receives data with an external communication device via the antenna. The external communication device includes, for example, a mobile communication terminal, such as a smartphone, a server, or the like. The image forming apparatus 100 may be configured to download the control program 122 from the server via the antenna.

The operation panel 130 includes, for example, a display and an input interface, such as a touch panel. The display and the touch panel are overlaid on each other. The operation panel 130 receives setting of a printing condition including the type of the recording material S according to the user's operation.

The storage 120 includes, for example, any of a hard disk, a solid state drive (SSD), and another storage. The storage 120 may be built in or externally provided. The storage 120 is capable of storing the control program 122, a plurality of determination criteria 124, and a basis weight threshold 126. A storage location of the control program 122, the plurality of determination criteria 124, and the basis weight threshold 126 is not limited to the storage 120 and may be a storage area (e.g., cache etc.) of the control device 101 or may be the ROM 102, the RAM 103, an external device (e.g., server), or the like.

[Detection of Amount of Emission Light and Amount of Transmission Light Performed by Light Amount Detector 90]

Figure 3:
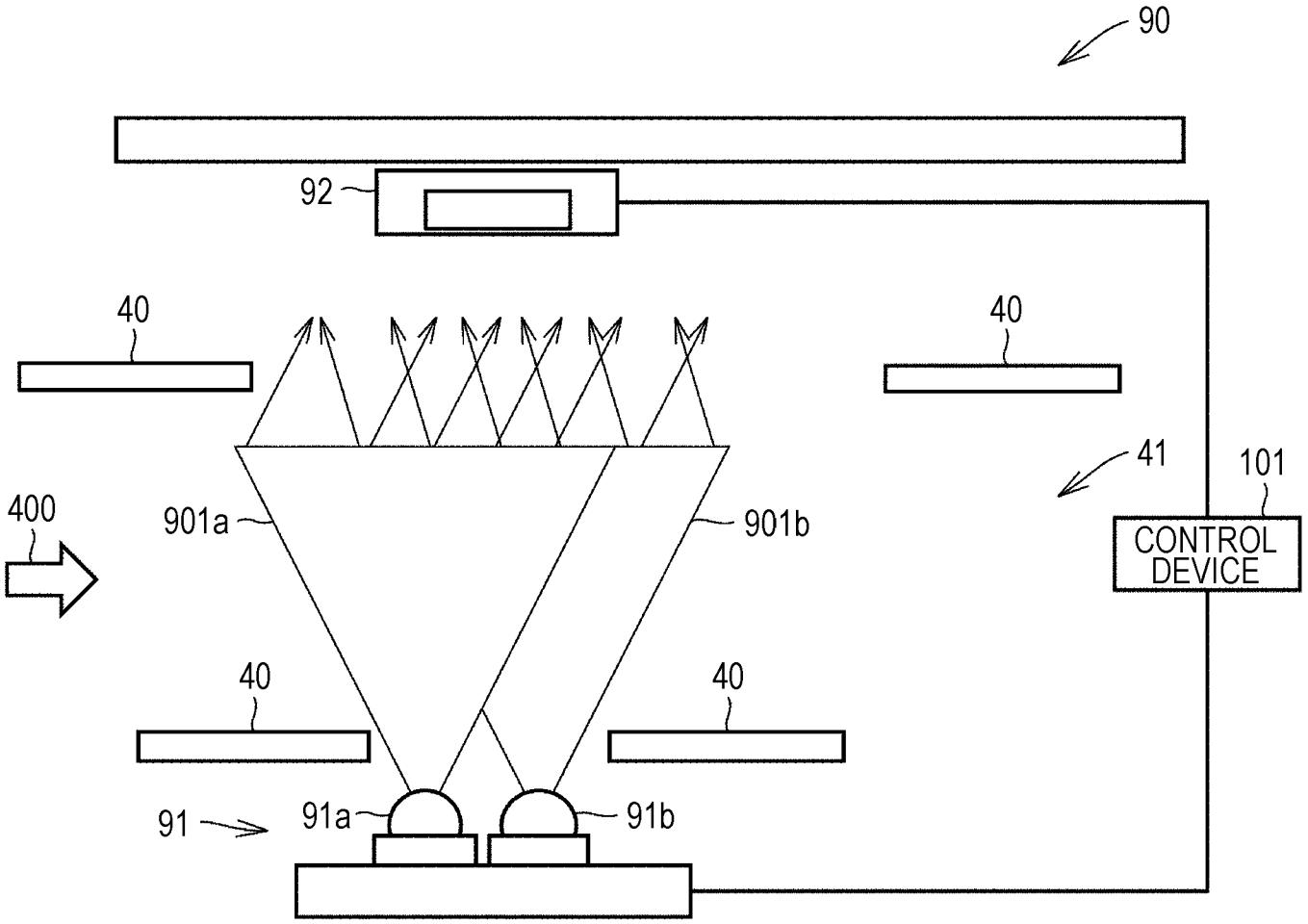
FIG. 3 is a diagram illustrating detection of an amount of emission light performed by a light amount detector.

Detection of the amount of emission light and the amount of transmission light performed by the light amount detector 90 will be described with reference to FIGS. 3 and 4. FIG. 3 is a diagram illustrating the detection of the amount of emission light performed by the light amount detector 90. The light amount detector 90 includes the light source 91, the optical sensor 92, and a guide 40. The light source 91 includes a first light source 91*a* and a second light source 91*b*. The first light source 91*a* emits first emission light 901*a* having a first wavelength. The first wavelength is, for example, a near-infrared wavelength longer than the wavelength of visible light. More specifically, the first wavelength includes, for example, a wavelength of 750 nm to 900 nm. The second light source 91*b* emits second emission light 901*b* having a second wavelength. The second wavelength is, for example, a wavelength of blue light included in the visible light. More specifically, the second wavelength includes, for example, a wavelength of 400 nm to 470 nm. The first emission light 901*a* and the second emission light 901*b* are emitted toward the paper feed path 41 in the guide 40.

In the guide 40, the paper feed path 41 through which the recording material S passes is formed. The recording material S is transported, for example, in the paper feed path 41 in a transport direction 400. The guide 40 is partially open in the transport direction 400. The partial opening enables the optical sensor 92 to reliably receive emission light from the light source 91 toward the paper feed path 41.

While the recording material S is not transported (when the emission light does not pass through the recording material S), the control device 101 outputs an instruction signal instructing the light source 91 to emit light and acquires an amount of light emitted, from the light source 91. More specifically, immediately before the optical sensor 92 detects an amount of first transmission light, which is described later, the control device 101 controls emission timing at which the first emission light 901*a* is emitted from the first light source 91*a* so that an amount of the first emission light 901*a* is detected by the optical sensor 92. The optical sensor 92 having been received the first emission light 901*a* outputs the amount of the first emission light 901*a* to the control device 101.

Furthermore, immediately before the optical sensor 92 detects an amount of second transmission light, which is described later, the control device 101 controls emission timing at which the second emission light 901*b* is emitted from the second light source 901*b* so that an amount of the second emission light 901*b* is detected by the optical sensor 92. The optical sensor 92 having been received the second emission light 901*b* outputs the amount of the second emission light 901*b* to the control device 101. The image forming apparatus 100 acquires the amount of emission light immediately before the detection of the amount of transmission light, and thus, even when the amount of emission light emitted from the light source 91 changes with time, the amount of emission light which is used to derive the basis weight of the recording material S is accurately detected.

The timing at which the first light source 91*a* emits the first emission light 901*a* is different from the timing at which the second light source 901*b* emits the second emission light 901*b*. For example, firstly, the first light source 91*a* emits the first emission light 901*a*, and after a predetermined time (e.g., 10 msec), the second light source 91*b* emits the second emission light 901*b*.

The first light source 91*a* may emit the first emission light 901*a* multiple times (e.g., five times) to one recording material S. The second light source 91*b* may emit the second emission light 901*b* multiple times (e.g., five times) to one recording material S. Each time the first emission light 901*a* and the second emission light 901*b* are emitted, the recording material S is transported at a predetermined speed in the paper feed path 41. The control device 101 acquires the amount of the first transmission light at each of different portions of the one recording material S. Furthermore, the control device 101 acquires the amount of second transmission light at each of different portions of the one recording material S. The control device 101 calculates a first transmittance at each of the different portions and a second transmittance at each of the different portions. Then, the control device 101 calculates an average first transmittance by arithmetic mean of the first transmittances and an average second transmittance by arithmetic mean of the second transmittances. Even when there is a difference between the transmittances at different portions of the one recording material S, the image forming apparatus 100 can calculate the transmittance with a reduced difference.

Figure 4:
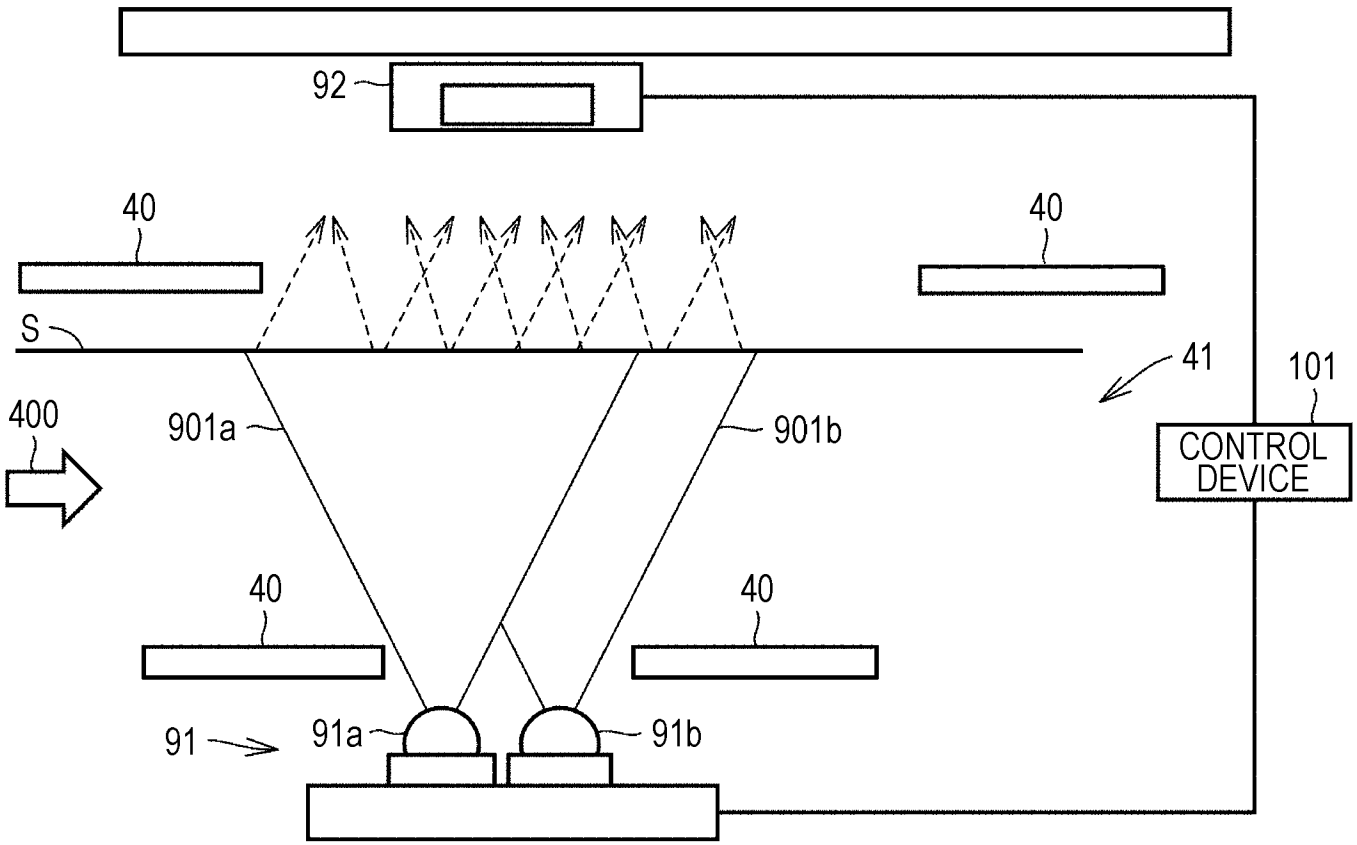
FIG. 4 is a diagram illustrating detection of an amount of transmission light performed by the light amount detector.

FIG. 4 is a diagram illustrating detection of the amount of transmission light performed by the light amount detector 90. In FIG. 4, while the recording material S is transported, the control device 101 controls emission timing at which the first emission light 901*a* is emitted from the first light source 91*a* so that the first emission light 901*a* is emitted toward the paper feed path 41. The optical sensor 92 receives first transmission light obtained according to the transmission of the first emission light 901*a* through the recording material S and detects an amount of the first transmission light. The optical sensor 92 outputs the amount of the first transmission light to the control device 101.

Next, while the recording material S is transported, the control device 101 controls emission timing at which the second emission light 901*b* is emitted from the second light source 91*b* so that the second emission light 901*b* is emitted toward the paper feed path 41. The optical sensor 92 receives second transmission light obtained according to the transmission of the second emission light 901*b* through the recording material S and detects an amount of the second transmission light. The optical sensor 92 outputs the amount of the second transmission light to the control device 101.

The control device 101 acquires an amount of the first emission light 901*a* and an amount of the first transmission light and calculates a first transmittance therefrom. More specifically, the control device 101 calculates the first transmittance by dividing the amount of the first transmission light by the amount of the first emission light 901*a*. The control device 101 acquires an amount of the second emission light 901*b* and an amount of the second transmission light and calculates a second transmittance therefrom. More specifically, the control device 101 calculates the second transmittance by dividing the amount of the second transmission light by the amount of the second emission light 901*b*. The control device 101 determines the type of the recording material S on the basis of the calculated first transmittance and second transmittance. The determination of the type of the recording material S will be described later.

[Function Performed by Control Device 101]

Figure 5:
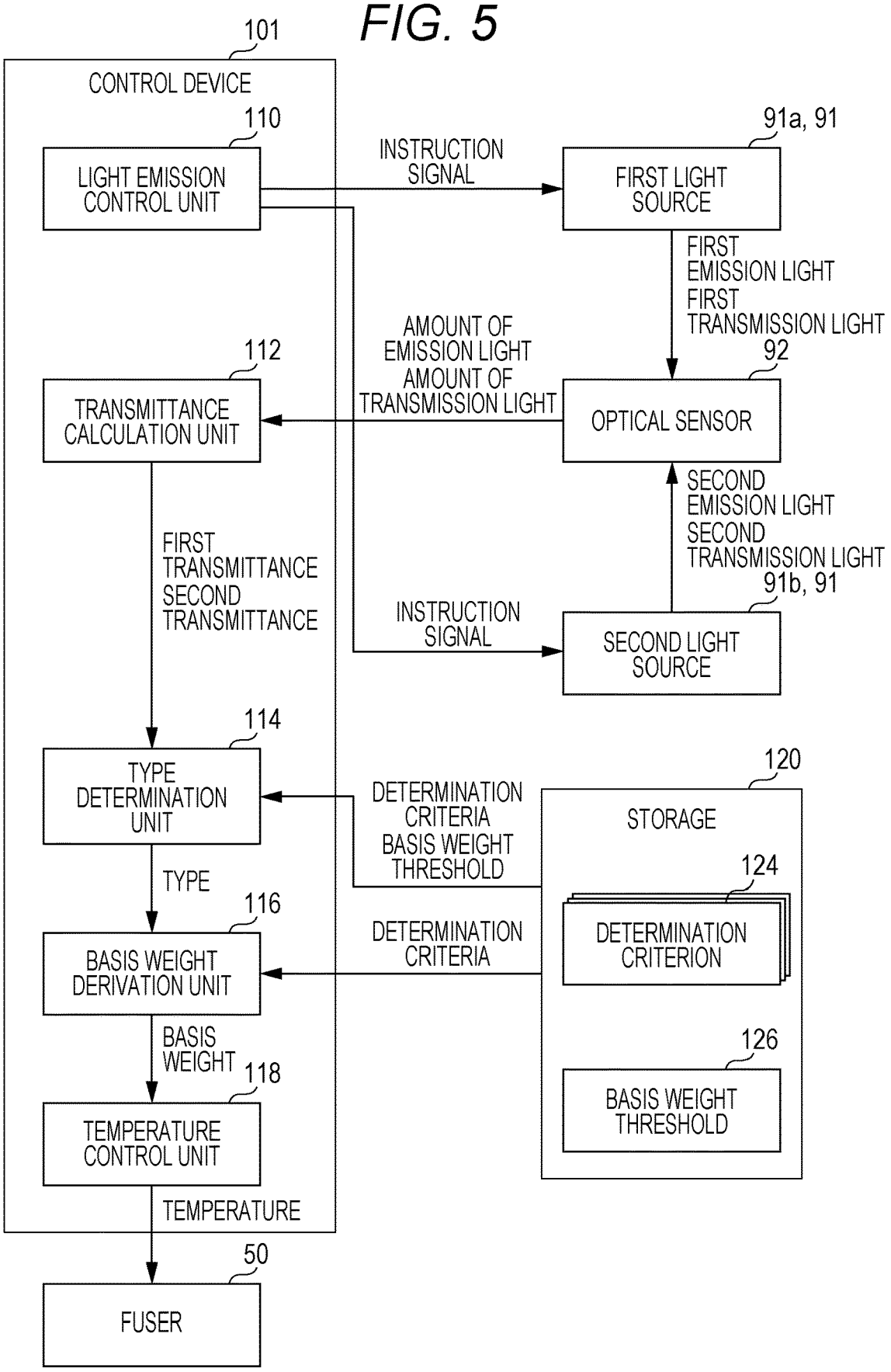
FIG. 5 is a diagram illustrating functions including determination of the type of a recording material, performed by a control device.

FIG. 5 is a diagram illustrating functions including determination of the type of the recording material S, performed by the control device 101. With reference to FIG. 5, a function for controlling the light source 91 will be described first, and then functions executed thereafter will be described in sequence. The control device 101 functions as a light emission control unit 110 for controlling timing at which the light source 91 emits emission light. The light emission control unit 110 outputs an instruction signal instructing the first light source 91*a* and the second light source 91*b* to emit emission light. The first light source 91*a* and the second light source 91*b* emit first emission light 901*a* and second emission light 901*b*, respectively, at different timings.

The optical sensor 92 receives the first emission light 901*a* and the second emission light 901*b*, detects amounts of the first emission light 901*a* and the second emission light 901*b*, and outputs the detected amounts of the first emission light 901*a* and the second emission light 901*b* to the control device 101. When the recording material S is transported, the optical sensor 92 receives first transmission light obtained according to the transmission of the first emission light 901*a* through the recording material S, and second transmission light obtained according to the transmission of the second emission light 901*b* through the recording material S, detects an amount of first transmission light and an amount of the second transmission light, and outputs the amounts of the first transmission light and the second transmission light to the control device 101.

The control device 101 as a transmittance calculation unit 112 calculates transmittances on the basis of the amounts of the emission light and the amounts of the transmission light. The transmittance calculation unit 112 calculates a first transmittance by dividing the amount of the first transmission light by the amount of the first emission light 901*a*. The transmittance calculation unit 112 calculates a second transmittance by dividing the amount of the second transmission light by the amount of the second emission light 901*b*.

The control device 101 as a type determination unit 114 determines a type of the recording material S on the basis of the calculated first transmittance and second transmittance. More specifically, the type determination unit 114 uses the first transmittance and the second transmittance, predetermined determination criteria of the plurality of determination criteria 124 stored in the storage 120, and the basis weight threshold 126 to determine the type of the recording material S. Details of the process for determining the type of the recording material S will be described later.

The control device 101 as a basis weight derivation unit 116 derives a basis weight according to a determination criterion based on the determined type of the recording material S. Details of the process for deriving the basis weight will be described later.

The control device 101 as a temperature control unit 118 controls the temperature of the fuser 50 on the basis of the derived basis weight. The temperature control unit 118 outputs a temperature to the fuser 50 on the basis of the basis weight of the recording material S. For example, when the basis weight is larger than a reference basis weight, the temperature control unit 118 outputs a temperature higher than a temperature currently set. Thus, the temperature of the heater 54 rises, the temperature of the fusing belt 52 also rises, and a toner image is further readily fused to the recording material S. Note that the control device 101 may change a transport speed at which the recording material S is transported in the fuser 50, on the basis of the basis weight of the recording material S.

[Determination Criteria]

Figure 6:
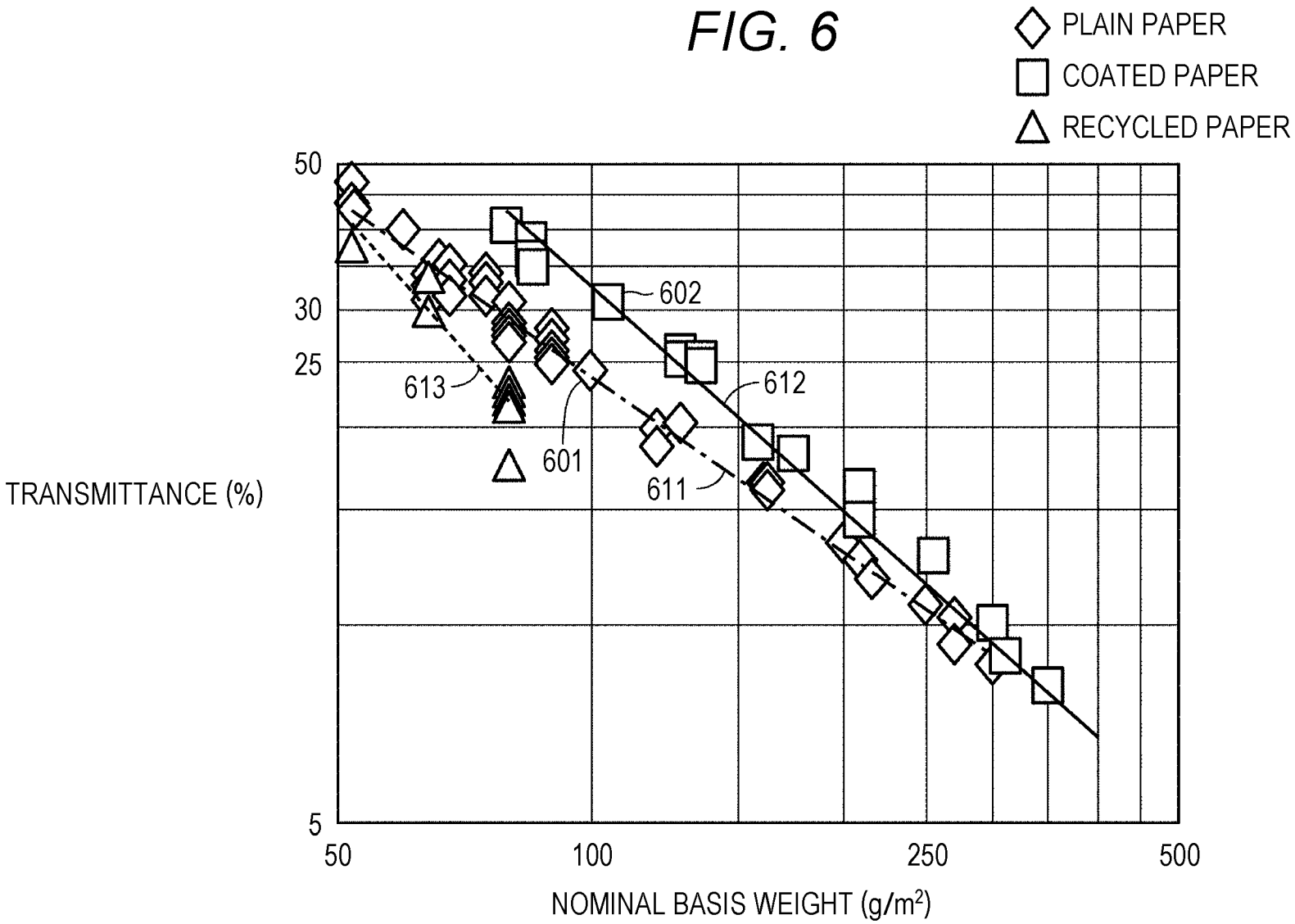
FIG. 6 is a graph illustrating determination criteria indicating relationships between first transmittance and nominal basis weight.

The determination criteria will be described with reference to FIGS. 6 to 8. FIG. 6 is a graph illustrating determination criteria indicating relationships between first transmittance and nominal basis weight. More specifically, FIG. 6 illustrates the relationships between nominal basis weight and transmittance obtained by emitting the first emission light 901*a* (near-infrared light) having a first wavelength to plain paper, coated paper, and recycled paper. The transmittances are each a value obtained by experiment. The nominal basis weights are each a basis weight of a recording material S disclosed by a manufacturer or the like who makes the recording material S.

In FIG. 6, an index indicating a relationship between a transmittance and a nominal basis weight of plain paper is represented by a diamond shape, an index indicating a relationship between a transmittance and a nominal basis weight of coated paper is represented by a square shape, and an index indicating a relationship between a transmittance and a nominal basis weight of recycled paper is represented by a triangle shape. For example, an index 601 indicates that plain paper has a transmittance calculated from experiment of approximately 25% and the plain paper used for the experiment has a nominal basis weight of approximately 100 $g/m^2$. In another example, an index 602 indicates coated paper has a transmittance calculated from experiment is approximately 30% and the coated paper used for the experiment has a nominal basis weight of approximately 100 $g/m^2$. In addition, the transmittance of recycled paper is also calculated from experiment and the nominal basis weight of the recycled paper used for the experiment is indicated by the index.

In the experiment, a plurality of indices of plain paper, a plurality of indices of coated paper, and a plurality of indices of recycled paper are calculated. On the basis of these indices, for example, an approximate line using a least squares method is derived by a control unit (not illustrated) provided in a personal computer (PC) used for the experiment. More specifically, a determination criterion 611 (one-dot chain line) for plain paper, a determination criterion 612 (solid line) for coated paper, and a determination criterion 613 (broken line) for recycled paper are derived. The plurality of determination criteria 124 including the determination criteria 611 to 613 are stored in the storage 120.

Figure 7:
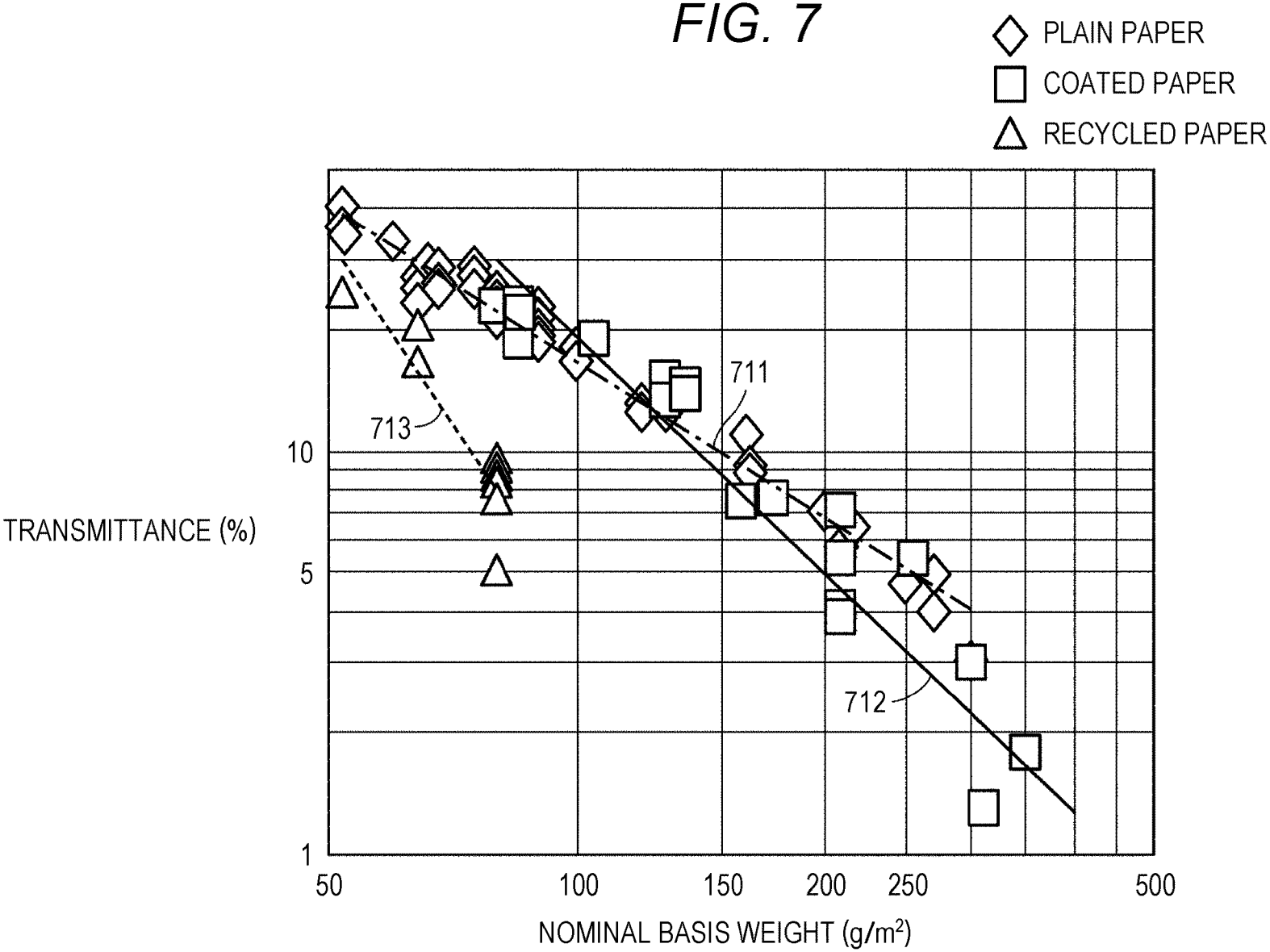
FIG. 7 is a graph illustrating determination criteria indicating relationships between second transmittance and nominal basis weight.

FIG. 7 is a graph illustrating determination criteria indicating relationships between second transmittances and nominal basis weights. More specifically, FIG. 7 illustrates the relationships between nominal basis weight and transmittance obtained by emitting the second emission light 901*b* (blue light in visible light) having a second wavelength to plain paper, coated paper, and recycled paper. In FIG. 7, an index indicating a relationship between a transmittance and a nominal basis weight of plain paper is represented by a diamond shape, an index indicating a relationship between a transmittance and a nominal basis weight of coated paper is represented by a square shape, and an index indicating a relationship between a transmittance and a nominal basis weight of recycled paper is represented by a triangle shape.

A plurality of indices is calculated for each of the plain paper, coated paper, and recycled paper. On the basis of these indices, for example, an approximate line using a least squares method is derived by a control unit provided in a PC used for the experiment. More specifically, a determination criterion 711 (one-dot chain line) for plain paper, a determination criterion 712 (solid line) for coated paper, and a determination criterion 713 (broken line) for recycled paper are derived. The storage 120 is configured to store the plurality of determination criteria 124 including the determination criteria 711 to 713.

The storage 120 may store the determination criteria represented by the approximate lines as a table or may store mathematical formulas corresponding to the approximate lines. For example, the determination criteria 611 to 613 are represented by the following formula (1) where a basis weight is y1.

$$y1=\exp(b1\times\mathrm{Log}(x1)+b2) \quad (1)$$

In formula (1), x1 is the first transmittance, and b1 and b2 are constants. The first transmittance used in formula (1) is a value obtained by dividing the transmittance by 100 (e.g., when the transmittance is 25%, 25/100=0.25). The control device 101 reads formula (1) stored in the storage 120 and substitutes the transmittance into formula (1) to derive the basis weight. Note that changing at least one of the constants b1 and b2 generates a formula corresponding to any of the determination criterion 611, the determination criterion 612, and the determination criterion 613.

For example, the determination criteria 711 to 713 are represented by the following formula (2) where a basis weight is y2.

$$y2=\exp(a1\times\mathrm{Log}(x2)^2+a2\times\mathrm{Log}(x2)+a3) \quad (2)$$

In formula (2), x2 is the second transmittance, and a1, a2, and a3 are constants. The second transmittance used in formula (2) is a value obtained by dividing the transmittance by 100 (e.g., when the transmittance is 30%, 30/100=0.3). The control device 101 reads formula (2) stored in the storage 120 and substitutes the transmittance into formula (2) to derive the basis weight. Note that changing at least one of the constants a1, a2, and a3 generates a formula corresponding to any of the determination criterion 711, the determination criterion 712, and the determination criterion 713.

The reason why the first wavelength and the second wavelength are used to calculate the transmittances is because these wavelengths have smaller variations in the indices forming the approximate lines in the determination criteria than other wavelengths. More specifically, a large number of the indices indicating the relationships between nominal basis weight and transmittance at the first wavelength and the second wavelength are located at a position on or closer to the approximate lines, compared with indices indicating relationships between nominal basis weight and transmittance at other wavelengths. The transmittances and the basis weights at the first wavelength and the second wavelength have a higher correlation, compared with those at the other wavelengths. Therefore, the first emission light 901*a* having a first wavelength and the second emission light 901*b* having a second wavelength are used to calculate the transmittances for deriving the basis weight.

Figure 8:
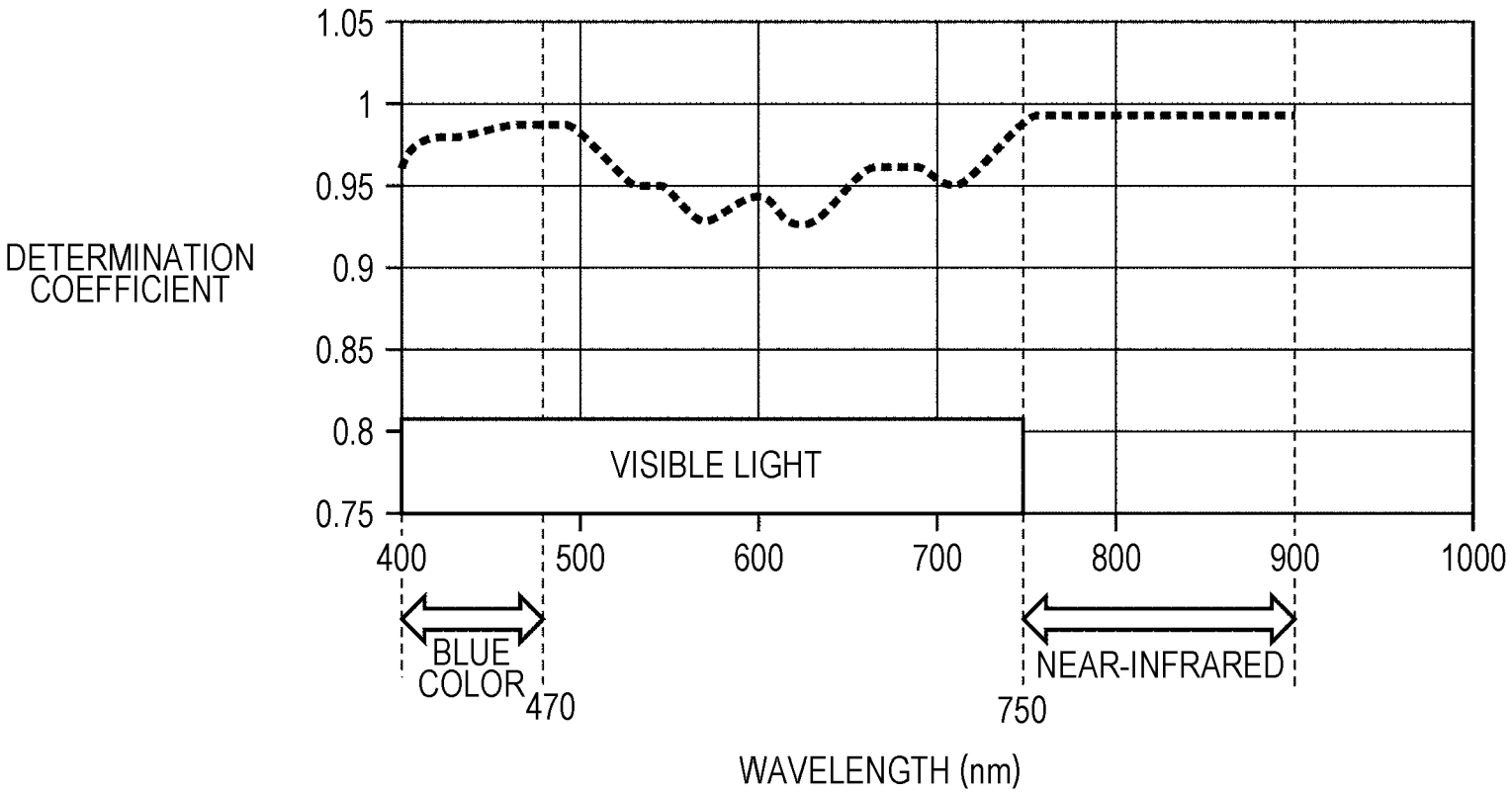
FIG. 8 is a graph illustrating a correlation between transmittance and nominal basis weight in terms of wavelength.

FIG. 8 is a graph illustrating a correlation between transmittance and nominal basis weight in terms of wavelength. As illustrated in FIG. 8, the first wavelength corresponding to a near-infrared wavelength (750 nm to 900 nm) having a relatively long wavelength (nm) and the second wavelength corresponding to a wavelength (400 nm to 470 nm) of blue light of visible light have a determination coefficient having a value closer to "1", compared with those of other wavelengths (e.g., 500 nm to 700 nm). When the determination coefficient at a certain wavelength has a value closer to "1", emission light having the wavelength has a high correlation between transmittance and nominal basis weight. When the transmittance and the nominal basis weight have a high correlation therebetween, dispersion of the plurality of indices from the approximate line decreases, compared with when the transmittance and the nominal basis weight have a low correlation. As illustrated in FIG. 8, the determination coefficient has a value closer to "1" at the first wavelength and the second wavelength, and thus the emission light having these wavelengths has a high correlation between transmittance and nominal basis weigh. Note that the values indicating the correlation between transmittance and basis weight in terms of wavelength of FIG. 8 is obtained by the experiments illustrated in FIGS. 6 and 7. Furthermore, although, in FIG. 8, the correlation in plain paper is illustrated, another type (e.g., coated paper or the like) of recording materials S has a similar correlation.

The reason why the correlation differs depending on the wavelength is that even if the recording materials S have the same type, components constituting the recording materials S are different. The recording materials S of the same type have a similar nominal basis weight, but when the recording materials S have different components, different transmittances may be detected upon emission of emission light to the recording materials S. The recording material S contains, for example, at least one of calcium carbonate, kaolin, talc, satin white, and the like In a case where any of these components are included in the recording material S, dispersion of an index based on the first emission light 901*a* having a first wavelength and an index based on the second emission light 901*b* having a second wavelength from the respective approximate lines decreases, and dispersion of indices based on emission light having other wavelengths from the approximate lines increases.

The image forming apparatus 100 calculates a transmittance by using emission light having a wavelength which has a high correlation between transmittance and nominal basis weight compared with the other wavelength and derives a basis weight corresponding to the transmittance, enabling derivation of accurate basis weight. Note that, even when a basis weight is derived by using the emission light having a wavelength which has a high correlation between transmittance and nominal basis weight, a difference between the derived basis weight and the nominal basis weight may considerably increase depending on the components of the recording material S. Therefore, emission light (e.g., the first emission light 901*a* having a first wavelength and the second emission light 901*b* having a second wavelength) having wavelengths which have a high correlation between transmittance and nominal basis weight is used to derive basis weights, and on the basis of the respective basis weights, a basis weight having a small difference from the nominal basis weight is derived. Details of the process for deriving the basis weight having a small difference from the nominal basis weight will be described later.

[Determination of Type of Recording Material S by Using Basis Weight Threshold 126]

Figure 9:
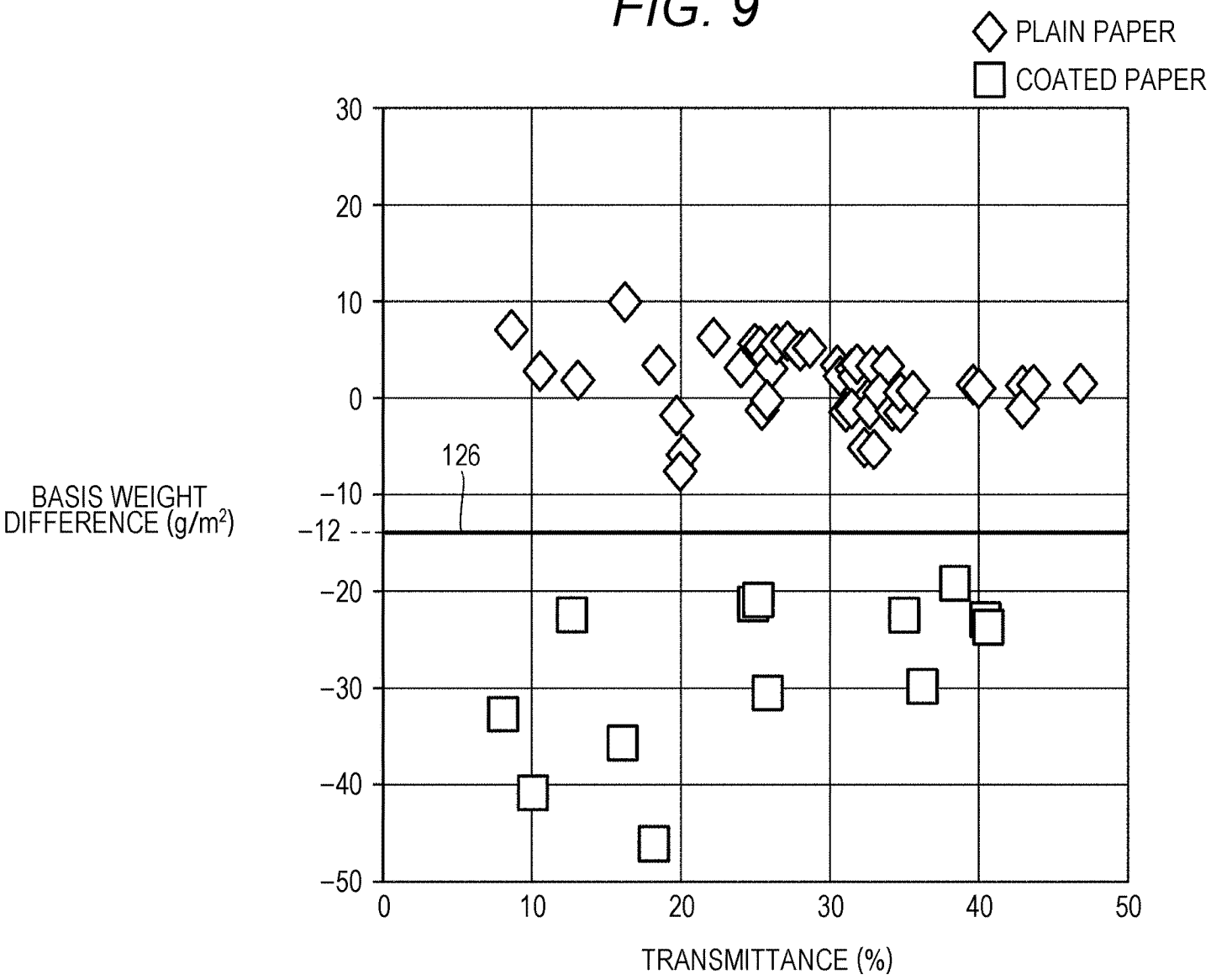
FIG. 9 is a graph illustrating a basis weight threshold and indices indicating a correspondence between transmittance and basis weight difference.

With reference to FIG. 9, the basis weight threshold 126 as a reference for determining the type of the recording material S will be described. FIG. 9 is a graph illustrating the basis weight threshold 126 and indices indicating a correspondence between transmittance and basis weight difference. More specifically, each of the indices indicates a correspondence between transmittance and basis weight difference in plain paper, and a correspondence between transmittance and basis weight difference in coated paper. The transmittance and the basis weight difference are values obtained by experiment. The transmittance is, for example, the first transmittance calculated by using the first emission light 901*a* (near-infrared light) having the first wavelength. The basis weight difference indicates a difference between a first basis weight and a second basis weight. The first basis weight is a basis weight corresponding to a transmittance derived by using the determination criterion 611 for plain paper at the first wavelength, as illustrated in FIG. 6. The second basis weight is a basis weight corresponding to a transmittance derived by using the determination criterion 711 for plain paper at the second wavelength, as illustrated in FIG. 7.

In FIG. 9, an index indicating a relationship between a transmittance and a basis weight difference of plain paper is represented by a diamond shape. The indices of plain paper are plotted at positions where the basis weight difference corresponding to the transmittance is approximately −10 g/m$^2$ or more. An index indicating a relationship between a transmittance and a basis weight difference of coated paper is represented by a square shape. The indices of coated paper are plotted at positions where the basis weight difference corresponding to the transmittance is approximately −15 g/m$^2$ or less. On the basis of the basis weight differences in the plain paper and the coated paper, a threshold for determining the type of plain paper or coated paper is set. For example, the basis weight threshold 126 defining the basis weight difference as −12 g/m$^2$ is set and stored in the storage 120.

The reason why an index of coated paper is larger than an index of plain paper in basis weight difference is that a basis weight corresponding to the first transmittance and a basis weight corresponding to the second transmittance are derived by using predetermined determination criteria (e.g., determination criteria for plain paper).

More specifically, the reason why the index of the coated paper is larger than the index of the plain paper in basis weight difference is as follows. Firstly, in a case where the recording material S is plain paper, it is assumed that whichever of the determination criterion 611 and the determination criterion 711 is used as the determination criterion for plain paper, substantially the same basis weight is derived. Furthermore, in a case where the recording material S is coated paper, it is assumed that whichever of the determination criterion 612 and the determination criterion 712 is used as the determination criteria for coated paper, substantially the same basis weight is derived.

Next, when a basis weight corresponding to a transmittance of the recording material S is derived by using the determination criterion 711 for plain paper, a difference in basis weight is relatively small, compared with when a basis weight corresponding to the same transmittance is derived by using the determination criterion 712 for coated paper. As an example of the relatively small difference in basis weight, FIG. 7 shows a difference between a nominal basis weight of the determination criterion 711 at a certain transmittance and a nominal basis weight of the determination criterion 712 at the same transmittance. Since the difference in basis weight is relatively small, even when the type of the recording material S is coated paper or plain paper, a difference in basis weight corresponding to the certain transmittance is small. In contrast, when a basis weight corresponding to a transmittance of the recording material S is derived by using the determination criterion 611 for plain paper, a difference in basis weight between plain paper and coated paper is relatively large, compared with when a basis weight corresponding to the same transmittance is derived by using the determination criterion 612 for coated paper. As an example of the relatively large difference in basis weight, FIG. 6 shows a difference between a nominal basis weight of the determination criterion 611 at a certain transmittance and a nominal basis weight of the determination criterion 612 at the same transmittance. At the same transmittance, the basis weight of coated paper is larger than a basis weight of plain paper. This is because the transmittance of coated paper tends to be larger than the transmittance of plain paper as the wavelength becomes longer.

According to the above assumption, when basis weights are derived by using the determination criterion 611 and the determination criterion 711 for plain paper, in a case where the recording material S employs plain paper, the basis weights derived according to the respective determination criteria have substantially the same value. In contrast, when the recording material S employs coated paper, the basis weight derived by using the determination criterion 611 for plain paper is smaller than the actual basis weight of the recording material S (a basis weight derived by using the determination criterion 612 for coated paper). The basis weight derived by using the determination criterion 711 for plain paper is substantially the same as the actual basis weight (a basis weight derived by using the determination criterion 712 for coated paper). Therefore, when the recording material S uses coated paper, a value obtained by subtracting the basis weight derived by using the determination criterion 711 from the basis weight derived by using the determination criterion 611 is smaller than a value obtained by subtracting the second basis weight derived by using the determination criterion 711 from the basis weight derived by using the determination criterion 611 when the recording material uses plain paper.

The type determination unit 114 derives the first basis weight and the second basis weight on the basis of the first transmittance and the second transmittance and the determination criteria 611 and 711 for plain paper, and when a value obtained by subtracting the second basis weight from the first basis weight is the value of the basis weight threshold 126 or more, the type determination unit 114 determines that the type of the recording material S is plain paper. Furthermore, when the value obtained by subtracting the second basis weight from the first basis weight is less than the value of the basis weight threshold 126, the control device 101 determines that the type of the recording material S is coated paper. The image forming apparatus 100 can accurately determine the type of the recording material S on the basis of a difference in basis weight.

[Derivation of Basis Weight of Recording Material S]

Referring back to FIG. 5, the basis weight derivation unit 116 of the control device 101 reads a determination criterion based on the type of the recording material S from among the plurality of determination criteria 124 stored in the storage 120. More specifically, for example, when the type of the recording material S is determined to be plain paper, the basis weight derivation unit 116 reads the determination criterion 611 and the determination criterion 711 as the determination criteria for plain paper. The basis weight derivation unit 116 derives a first basis weight corresponding to a first transmittance according to the determination criterion 611. The basis weight derivation unit 116 derives a second basis weight corresponding to a second transmittance according to the determination criterion 711. The basis weight derivation unit 116 derives an average basis weight obtained by arithmetic mean of the first basis weight and the second basis weight. Note that, as described above, the first transmittance and the second transmittance may be the average first transmittance obtained by averaging the first transmittances at different portions and the average second transmittance obtained by averaging the second transmittances at different portions.

Figure 10:
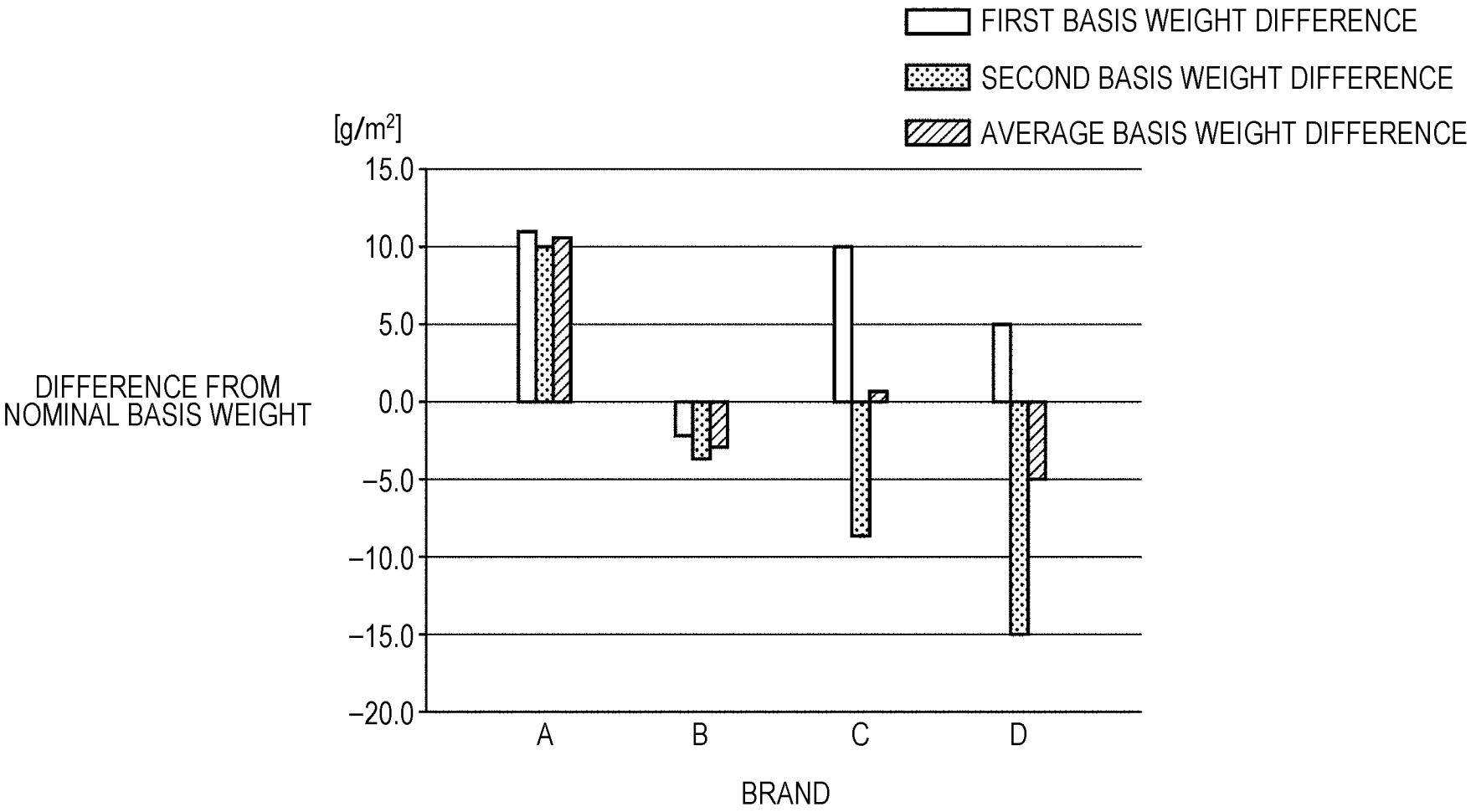
FIG. 10 is a graph illustrating difference between a basis weight and a nominal basis weight for each brand of the recording material.

FIG. 10 is a graph illustrating derivation of a basis weight having a small difference from a nominal basis weight. The control device 101 uses emission light having wavelengths which have a high correlation between transmittance and basis weight is used to derive a basis weight having a small difference from the nominal basis weight. More specifically, the control device 101 uses the first emission light 901*a* (near-infrared light) having a first wavelength to calculate the first transmittance and uses the second emission light 901*b* (blue light) having a second wavelength to calculate the second transmittance. The control device 101 derives a first basis weight corresponding to the first transmittance and a second basis weight corresponding to the second transmittance and derives an average basis weight obtained by arithmetic mean of the first basis weight and the second basis weight. Even when a difference between any of the first basis weight and the second basis weight and the nominal basis weight has a value equal to or larger than a predetermined value, the averaging the first basis weight and the second basis weight reduces the value of the difference between the basis weight calculated by the averaging and the nominal basis weight.

As illustrated in FIG. 10, the horizontal axis represents brands A to D of plain paper being the recording material S. The brands represent for example, trade names of plain paper, and different components may be contained in the brands. The brand A shows a first basis weight difference, a second basis weight difference, and an average basis weight difference from the left side. The first basis weight difference is a difference between a first basis weight and a nominal basis weight. The second basis weight difference is a difference between a second basis weight and a nominal basis weight. The average basis weight difference is a value obtained by arithmetic mean of the first basis weight difference and the second basis weight difference.

More specifically, the brand A has a first basis weight difference and second basis weight difference of approximately 10 g/m$^2$, and an average basis weight difference of approximately 10 g/m$^2$ which is also substantially the same as the respective basis weight differences. In the brand A, a difference between the first basis weight and the nominal basis weight has a value substantially the same as that of a difference between the second basis weight and the nominal basis weight, and differences between the basis weights and the nominal basis weight are small. The brand B has a first basis weight difference and second basis weight difference of approximately −3 g/m$^2$ and an average basis weight difference of approximately −3 g/m$^2$ which is also substantially the same as the respective basis weight differences. In the brand B, a difference between the first basis weight and the nominal basis weight has a value substantially the same as that of a difference between the second basis weight and the nominal basis weight, and differences between the basis weights and the nominal basis weight are small. In contrast, the brand C has a first basis weight difference of approximately 10 g/m$^2$, a second basis weight difference of approximately −8 g/m$^2$, and an average basis weight difference of approximately 1 g/m$^2$. Furthermore, the brand D has a first basis weight difference of approximately 5 g/m$^2$, a second basis weight difference of approximately −15 g/m$^2$, and an average basis weight difference of approximately −5 g/m$^2$. If only one of the first basis weight and second basis weight is employed as the basis weight of the recording material S, when there is a large difference between a derived basis weight and a nominal basis weight, the control device 101 cannot derive an accurate basis weight of the recording material S. Deriving a basis weight obtained by averaging two basis weights makes it possible to reduce a difference from a nominal basis weight, as compared with the use of a basis weight having a large difference from the nominal basis weight. Thus, the image forming apparatus 100 can derive an accurate basis weight of the recording material S.

[Process for Acquiring Amount of Emission Light]

Figure 11:
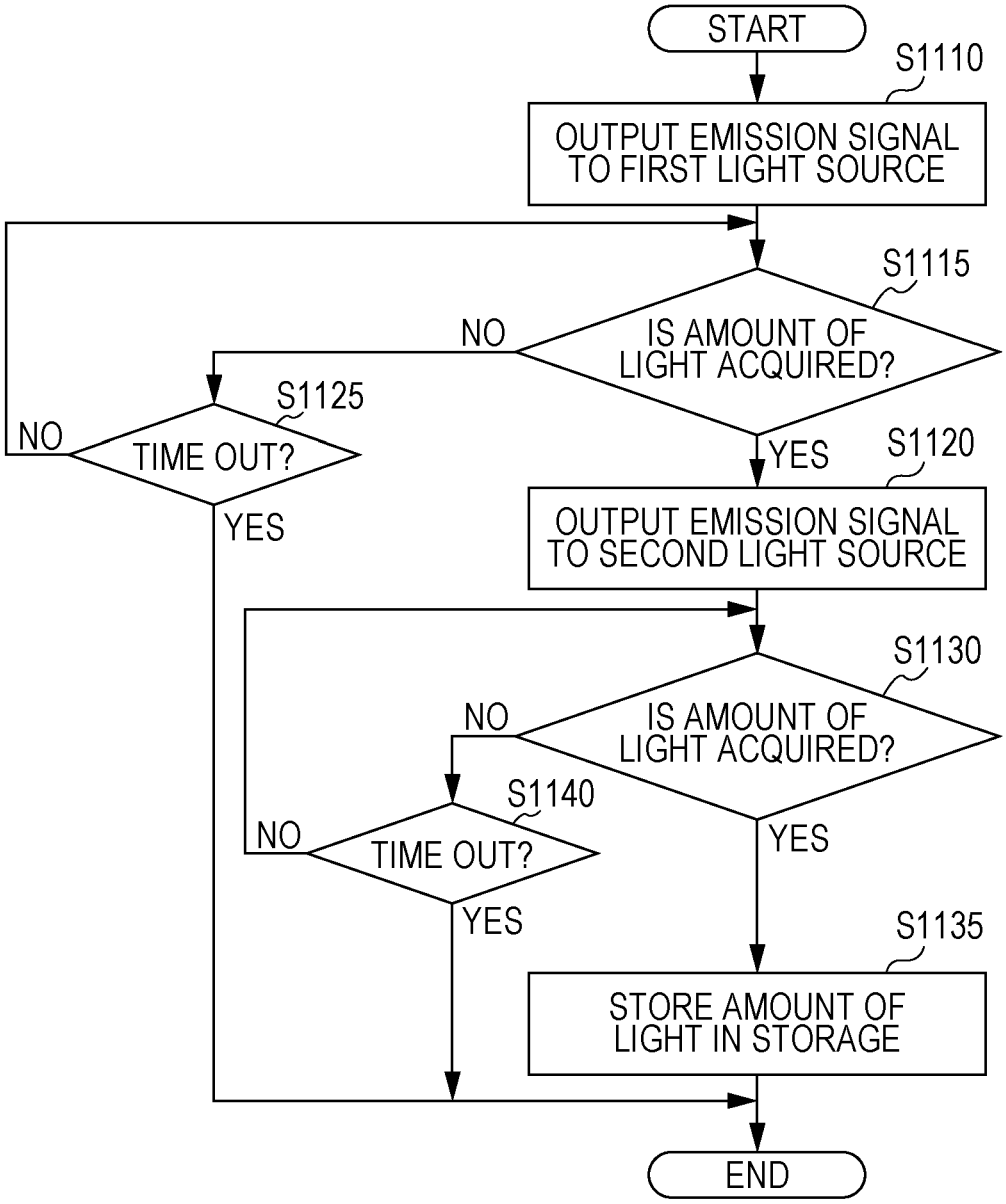
FIG. 11 is a flowchart illustrating a process for acquiring an amount of emission light emitted from a light source by the control device.

A control structure of the image forming apparatus 100 will be described with reference to FIG. 11. FIG. 11 is a flowchart illustrating a process for acquiring the amount of emission light emitted from a light source 91 by the control device 101. In step S1110, the light emission control unit 110 of the control device 101 outputs an instruction signal to the first light source 91*a* to emit the first emission light 901*a* (near-infrared light) having a first wavelength.

In step S1115, the control device 101 determines whether an amount of light has been acquired from the optical sensor 92, on the basis of information received from the optical sensor 92. When receiving the first emission light 901*a* emitted from the first light source 91*a*, the optical sensor 92 outputs the amount of the first emission light 901*a* to the control device 101. When determining acquisition of the amount of light from the optical sensor 92 (YES in step St 115), the control device 101 advances the control to step S1120. Otherwise (NO in step S115), the control device 101 advances the control to step S1125.

In step S1120, the light emission control unit 110 outputs an instruction signal to the second light source 91*b* to emit the second emission light 901*b* (blue light) having a second wavelength. The control device 101 outputs the instruction signal to the second light source 91*b* at timing different from timing at which the instruction signal is output to the first light source 91*a*. The instruction signal is a signal output from the control device 101 to the light source 91, and is a signal instructing the light source 91 to emit emission light.

In step S1125, the control device 101 measures, by using a timer (not illustrated), a duration of time from a time point at which it is determined whether the amount of the first emission light 901*a* is acquired. Upon timeout (YES in step S1125) after a predetermined period (e.g., one minute), the control device 101 finishes the process of FIG. 11. Otherwise (NO in step S1125), the control device 101 repeatedly performs the control of step S1115.

In step S1130, the control device 101 determines whether an amount of light has been acquired from the optical sensor 92. When receiving the second emission light 901*b* emitted from the second light source 91*b*, the optical sensor 92 outputs the amount of the second emission light 901*b* to the control device 101. When determining acquisition of the amount of light from the optical sensor 92 (YES in step S1130), the control device 101 advances the control to step S1135. Otherwise (NO in step S1130), the control device 101 advances the control to step S1140.

In step S1135, the control device 101 stores the amount of the first emission light 901*a* and the amount of the second emission light 901*b* acquired from the optical sensor 92 in the storage 120.

In step S1140, the control device 101 measures, by using a timer, a duration of time from a time point at which it is determined whether the amount of the second emission light 901*b* is acquired. Upon timeout (YES in step S1140) after a predetermined period (e.g., one minute), the control device 101 finishes the process of FIG. 11. Otherwise (NO in step S1140), the control device 101 repeatedly performs the control of step S1130.

[Process for Acquiring Amount of Transmission Light]

Figure 12:
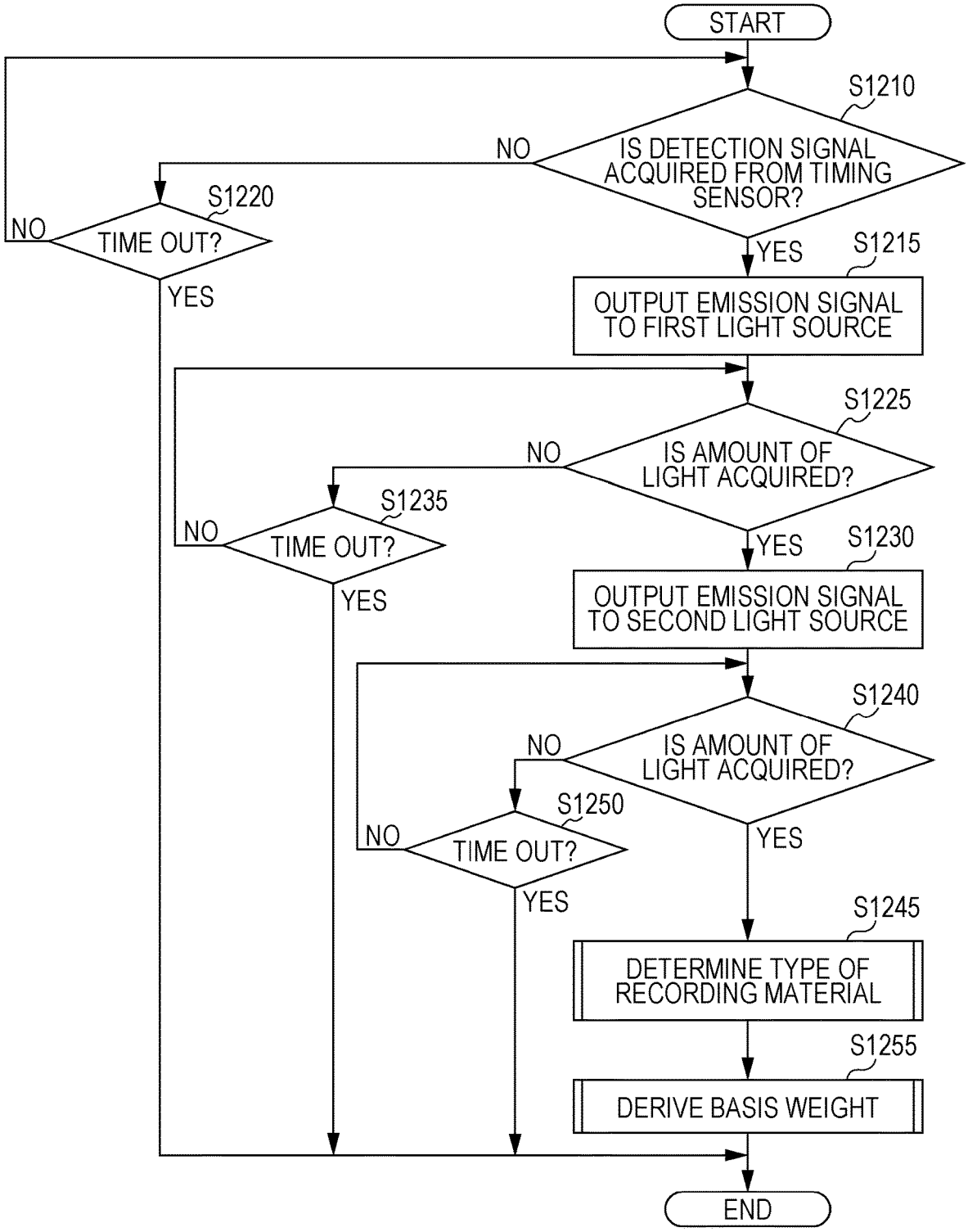
FIG. 12 is a flowchart illustrating a process for acquiring an amount of transmission light transmitted through the recording material by the control device.

FIG. 12 is a flowchart illustrating a process for acquiring an amount of transmission light transmitted through the recording material S by the control device 101. As illustrated in FIG. 12, in step S1210, the control device 101 determines whether a detection signal representing detection of the recording material S is acquired from the timing sensor 87. When determining acquisition of the detection signal from the timing sensor 87 (YES in step S1210), the control device 101 advances the control to step S1215. Otherwise (NO in step S1210), the control device 101 advances the control to step S1220.

In step S1215, after acquisition of the detection signal from the timing sensor 87, the control device 101 outputs an instruction signal to the first light source 91*a*.

In step S1220, the control device 101 measures, by using a timer, a duration of time from a time point at which the detection signal is acquired from the timing sensor 87. Upon timeout (YES in step S1220) after a predetermined period (e.g., one minute), the control device 101 finishes the process of FIG. 12. Otherwise (NO in step S1220), the control device 101 repeatedly performs the control of step S1210.

In step S1225, the control device 101 determines whether an amount of light has been acquired from the optical sensor 92. When receiving the first transmission light obtained according to the transmission of the first emission light 901*a* through the recording material S, the optical sensor 92 outputs an amount of the first transmission light to the control device 101. When determining acquisition of the amount of light from the optical sensor 92 (YES in step S1225), the control device 101 advances the control to step S1230. Otherwise (NO in step S1225), the control device 101 advances the control to step S1235.

In step S1230, the control device 101 outputs an instruction signal to the second light source 916*b*. The control device 101 outputs the instruction signal to the second light source 91*b* at timing different from timing at which the instruction signal is output to the first light source 91*a*.

In step S1235, the control device 101 measures, by using a timer, a duration of time from a time point at which it is determined whether the amount of the first emission light 901*a* is acquired. Upon timeout (YES in step S1235) after a predetermined period (e.g., one minute), the control device 101 finishes the process of FIG. 12. Otherwise (NO in step S1235), the control device 101 repeatedly performs the control of step S1225.

In step S1240, the control device 101 determines whether an amount of light has been acquired from the optical sensor 92. When receiving the second transmission light obtained according to the transmission of the second emission light 901*b* through the recording material S, the optical sensor 92 outputs an amount of the second transmission light to the control device 101. When determining acquisition of the amount of light from the optical sensor 92 (YES in step S1240), the control device 101 advances the control to step S1245. Otherwise (NO in step S1240), the control device 101 advances the control to step S1250.

In step S1245, the control device 101 determines the type of the recording material. The process of determining the type of the recording material will be described later.

In step S1250, the control device 101 measures, by using a timer, a duration of time from a time point at which it is determined whether the amount of the second emission light 901*b* is acquired. Upon timeout (YES in step S1250) after a predetermined period (e.g., one minute) according to the measurement of a time duration, the control device 101 finishes the process of FIG. 12. Otherwise (NO in step S1250), the control device 101 repeatedly performs the control of step S1240.

In step S1255, the control device 101 derives a basis weight of the recording material S. The process for deriving the basis weight will be described later.

[Process for Determining Type of Recording Material S]

Figure 13:
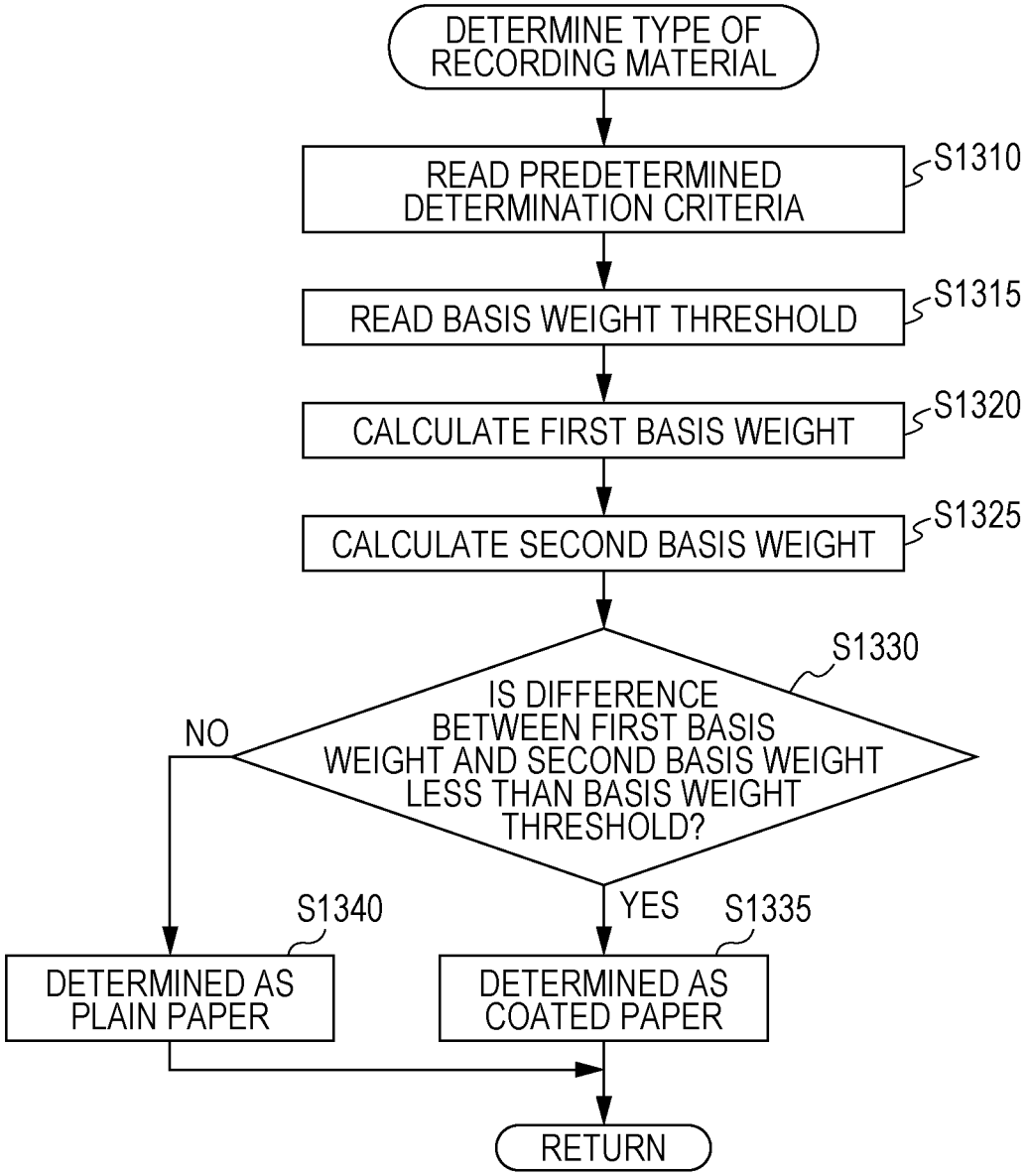
FIG. 13 is a flowchart illustrating a process for determining a type of the recording material by the control device according to a first embodiment.

FIG. 13 is a flowchart illustrating a process for determining a type of the recording material S by the control device 101 according to a first embodiment. As illustrated in FIG. 13, in step S1310, the control device 101 reads, from the storage 120, predetermined determination criteria (e.g., the determination criterion 611 and determination criterion 711 used for plain paper).

In step S1315, the control device 101 reads the basis weight threshold 126 from the storage.

In step S1320, the control device 101 derives, by using the determination criterion 611, a first basis weight corresponding to a first transmittance.

In step S1325, the control device 101 derives, by using the determination criterion 711, a second basis weight corresponding to a second transmittance.

In step S1330, the control device 101 determines whether a difference between a first basis weight and a second basis weight has a value less than the value of the basis weight threshold 126. When the difference between the first basis weight and the second basis weight has a value less than the value of basis weight threshold 126 (YES in step S1330), the control is advanced to step S1335. Otherwise (NO in step S1330), the control device 101 advances the control to step S1340.

In step S1330, the control device 101 determines the type of the recording material S as coated paper.

In step S1340, the control device 101 determines the type of the recording material S as plain paper. The image forming apparatus 100 can accurately determine the type of the recording material S by using a threshold representing a basis weight difference.

[Process for Driving Basis Weight of Recording Material S]

Figure 14:
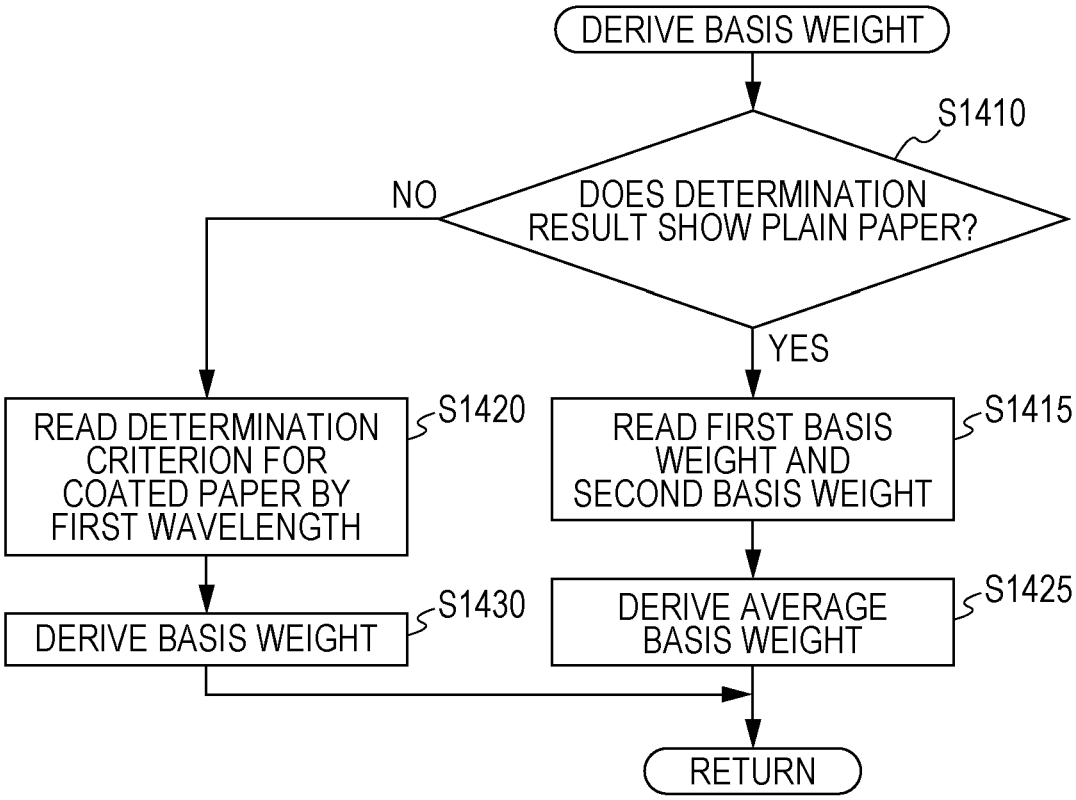
FIG. 14 is a flowchart illustrating a process for deriving a basis weight of the recording material by the control device according to the first embodiment.

FIG. 14 is a flowchart illustrating a process for deriving a basis weight of the recording material S by the control device 101 according to the first embodiment. As illustrated in FIG. 14, in step S1410, the control device 101 determines whether the type of the recording material S has been determined as plain paper, on the basis of a result of determination of the type of the recording material S in FIG. 13. When the determination result indicates plain paper (YES in step S1410), the control device 101 advances the control to step S1415. Otherwise (NO in step S1410), the control device 101 advances the control to step S1420.

In step S1415, the control device 101 reads the first basis weight and second basis weight derived in the process of FIG. 13, from the storage 120.

In step S1420, the control device 101 reads the determination criterion 612 for coated paper based on the first wavelength, from the storage 120.

In step S1425, the control device 101 derives an average basis weight obtained by arithmetic mean of the first basis weight and the second basis weight. The control device 101 controls the temperature or the like of the fuser 50 according to the derived basis weight.

In step S1430, the control device 101 uses the determination criterion 612 for coated paper to derive the basis weight corresponding to the first transmittance. The control device 101 sets the derived basis weight to control the temperature or the like of the fuser 50 according to the set basis weight. The image forming apparatus 100 can derive an accurate basis weight according to the type of the recording material S.

Note that when the type of the recording material S is determined as coated paper, the control device 101 may derive a basis weight obtained by arithmetic mean of a basis weight corresponding to a first transmittance and a basis weight corresponding to a second transmittance so that the basis weight is set as the basis weight of the recording material S for coated paper. Even if the recording material S have the same type and components constituting the recording materials S are different, performance of the process of FIG. 14 enables the image forming apparatus 100 to derive accurate basis weights of the recording materials S.

In addition, in step S1415, the use of the first basis weight and second basis weight stored in advance in the storage 120 has been described. In contrast, the control device 101 may calculate the first basis weight and the second basis weight on the basis of determination criteria.

Second Embodiment

Hereinafter, a second embodiment according to the present disclosure will be described. An image forming apparatus according to the second embodiment has configurations which are partially different from those of the image forming apparatus 100 according to the above embodiment, and the rest of the configurations are the same as those of the image forming apparatus 100 according to the above embodiment. Thus, the same configuration will not be described repeatedly. Hereinafter, different configurations and processes will be described.

In the second embodiment, the light amount detector 90 calculates a reflectance of the recording material S. The light amount detector 90 includes a third light source in addition to the first light source and second light source, and the type of the recording material S is determined on the basis of an amount of reflection light obtained when emission light emitted from the third light source is reflected from the recording material S.

[Configuration of Light Amount Detector 90]

Figure 15:
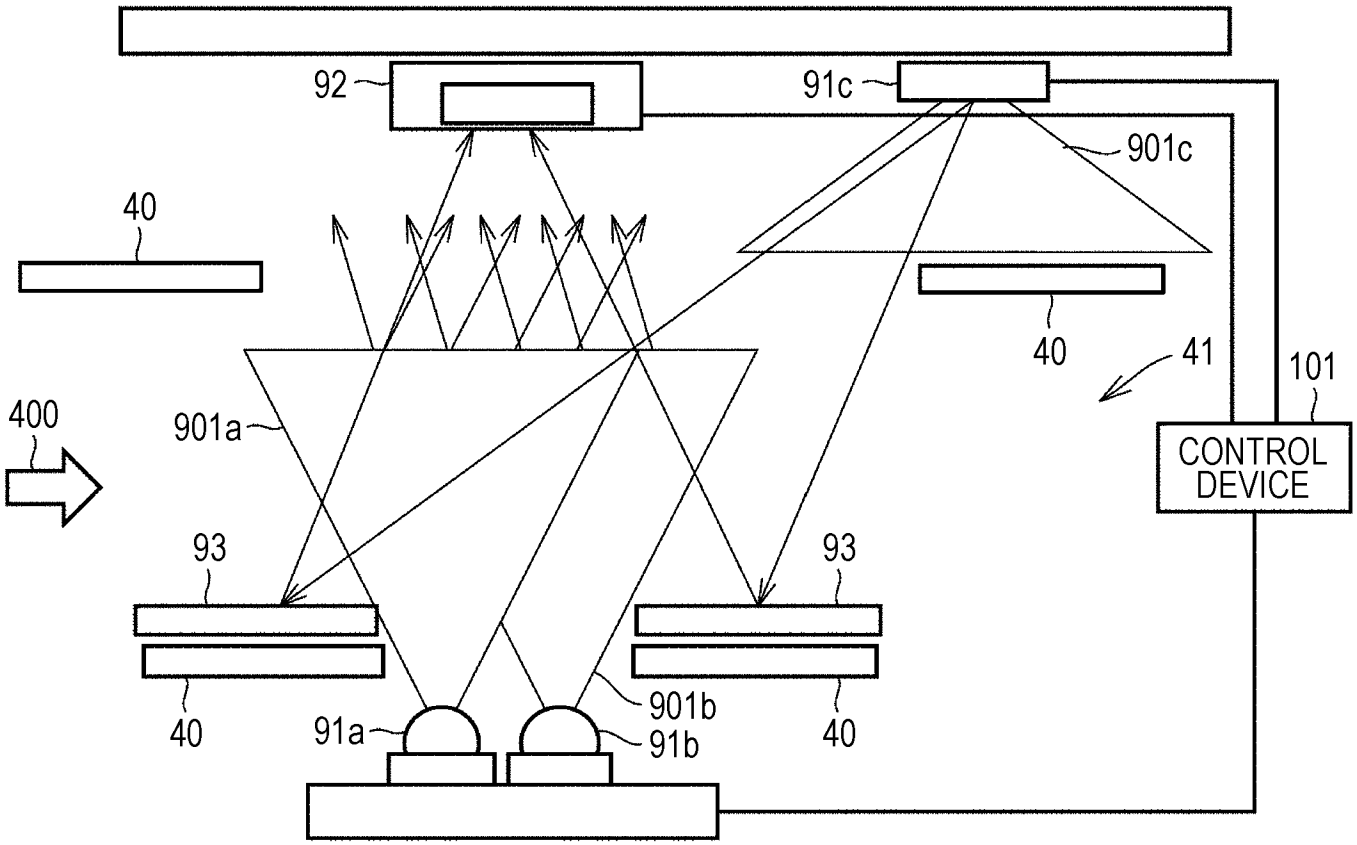
FIG. 15 is a diagram illustrating detection of an amount of first reflection light by the light amount detector.

FIG. 15 is a diagram illustrating detection of an amount of first reflection light by the light amount detector 90. The light amount detector 90 includes a third light source 91*c* provided in the vicinity of the optical sensor 92. The third light source 91*c* emits third emission light having a third wavelength toward the paper feed path 41. The third wavelength is, for example, a wavelength of green light in the visible light. More specifically, the third wavelength includes, for example, a wavelength of 495 nm to 570 nm. The third wavelength has a wavelength different from a first wavelength (e.g., a wavelength of 750 nm to 900 nm) and a second wavelength (e.g., a wavelength of 400 nm to 470 nm).

The third emission light 901*c* is emitted toward the paper feed path 41 in the guide 40. On the inside of the guide 40 provided in the vicinity of the first light source 91*a* and second light source 91*b*, a reflector 93 is provided. The reflector 93 is painted, for example, green which is the same as the color of the third emission light 901*c*, and reflects the third emission light 901*c*. In addition, the reflector 93 does not reflect the first emission light 901*a* (near-infrared light) and second emission light 901*b* (blue light) which have colors different from that of the third emission light 910*c*.

Immediately before the optical sensor 92 detects an amount of second transmission light, which is described later, the control device 101 controls emission timing at which the third emission light 901*c* is emitted from the third light source 91*c* so that the amount of first reflection light is detected by the optical sensor 92. The first reflection light is reflection light obtained when the third emission light 901*c* is reflected from the reflector 93.

The optical sensor 92 receives the first reflection light to detect an amount of the light and outputs an amount of the third emission light 901*c* to the control device 101.

Figure 16:
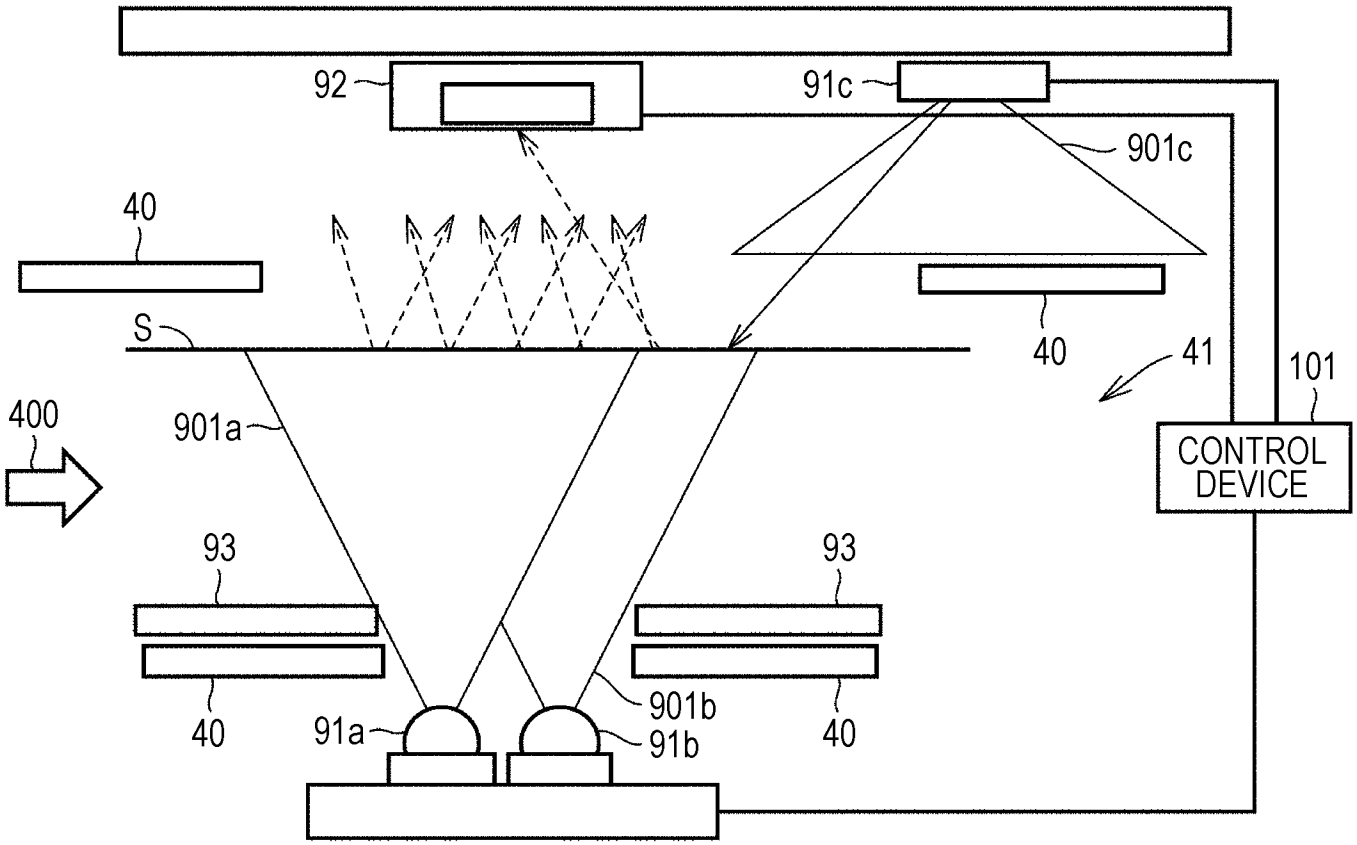
FIG. 16 is a diagram illustrating detection of an amount of second reflection light by the light amount detector.

FIG. 16 is a diagram illustrating detection of an amount of second reflection light by the light amount detector 90. As illustrated in FIG. 16, when the recording material S passes through the paper feed path 41, the control device 101 controls the third light source 91*c* so that the third emission light 901*c* is emitted toward the paper feed path 41. The optical sensor 92 receives the second reflection light to detect an amount of the second reflection light and outputs the detected amount of the second reflection light to the control device 101. The second reflection light is reflection light obtained when the third emission light 901*c* is reflected from the recording material S. The optical sensor 92 receives first transmission light obtained according to transmission of the first emission light 901*a* through the recording material S and second transmission light obtained according to transmission of the second emission light 901*b* through the recording material S, at timing different from timing at which the second transmission light is received. The optical sensor 92 outputs the detected amounts of the first transmission light and the second transmission light to the control device 101.

Figure 17:
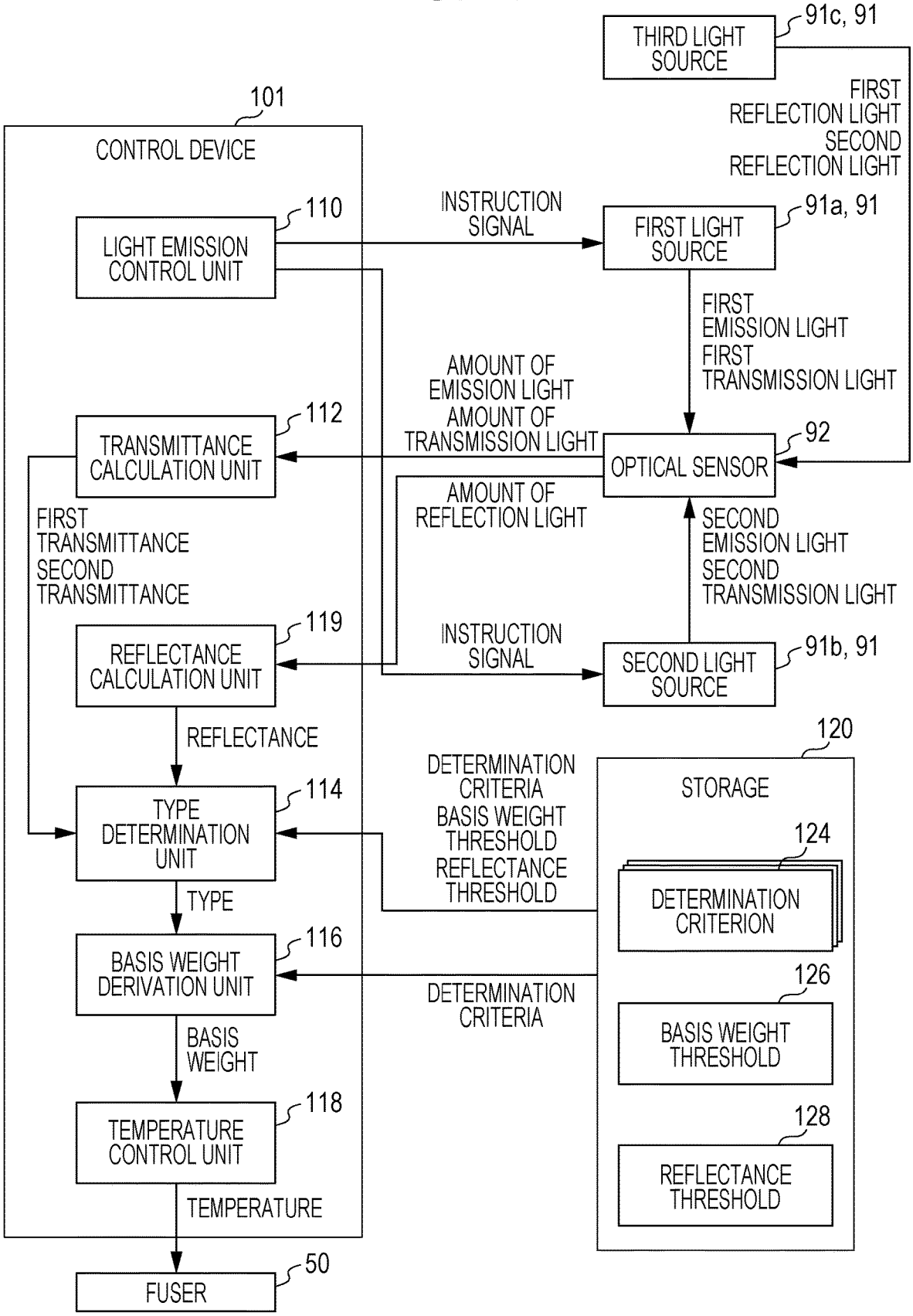
FIG. 17 is a diagram illustrating determination of the type of the recording material on the basis of reflectance.

FIG. 17 is a diagram illustrating determination of the type of the recording material S on the basis of reflectance. As illustrated in FIG. 17, the third emission light 901*c* emitted from the third light source 91*c* is reflected from the reflector 93, and the first reflection light is received by the optical sensor 92. Furthermore, the third emission light 901*c* emitted from the third light source 91*c* is reflected from the recording material S. and the second reflection light is received by the optical sensor 92. The optical sensor 92 outputs the amount of the first reflection light and the amount of the second reflection light to a reflectance calculation unit 119.

The reflectance calculation unit 119 divides the amount of the second reflection light by the amount of the first reflection light to calculate a reflectance.

The type determination unit 114 reads a reflectance threshold 128 from the storage 120 to determine the type of the recording material S.

[Determination of Type of Recording Material S by Using Reflectance Threshold 128]

Figure 18:
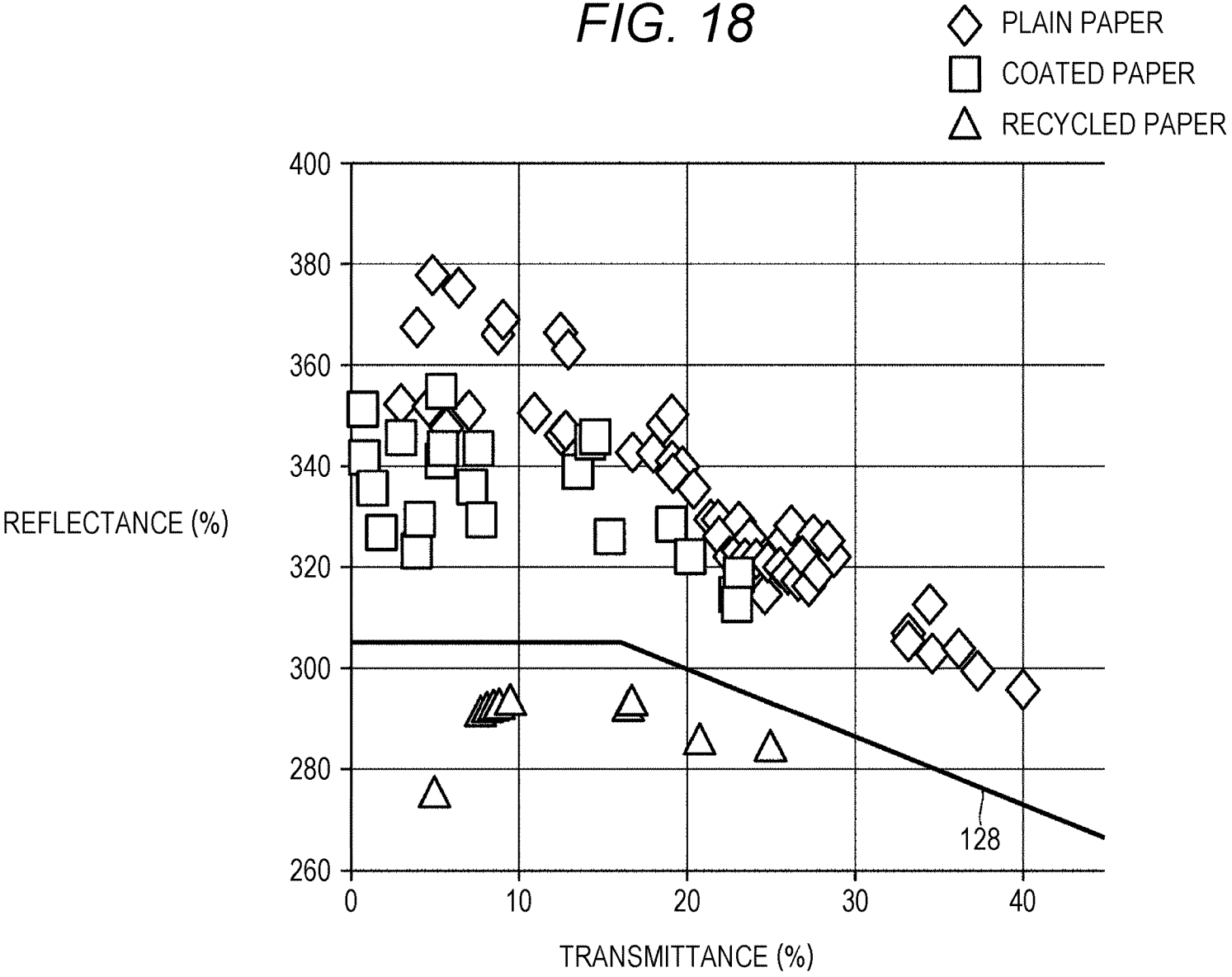
FIG. 18 is a graph illustrating a reflectance threshold and indices indicating a correspondence between transmittance and reflectance.

The reflectance threshold 128 will be described with reference to FIG. 18. FIG. 18 is a graph illustrating the reflectance threshold 128 and indices indicating a correspondence between transmittance and reflectance. The indices are derived by experiment and each represent a correspondence between transmittance (%) and reflectance (%) of each of plain paper, coated paper, and recycled paper. The transmittance employs, for example, a second transmittance calculated by using the second emission light 901*b* (blue light beam) having the second wavelength. The reason why the second transmittance is used that a difference is more likely to be caused between the reflectance of recycled paper and the reflectance of the other types of the recording materials S, compared with when another transmittance is used. The reflectance has a value obtained by dividing the amount of second reflection light by the amount of first reflection light.

In FIG. 18, as a result of experiment on a plurality of types of the recording materials S, a diamond-shaped index of plain paper shows that when the amount of first reflection light reflected from the reflector 93 is "1", the amount of second reflection light reflected from the recording material S becomes "3" or more (more than three times the amount of first reflection light). A square-shaped index of coated paper shows that when the amount of first reflection light is "1", the amount of second reflection light is "3" or more (more than three times the amount of first reflection light). In contrast, a triangle-shaped index of recycled paper shows that when the amount of first reflection light is "1", the amount of second reflection light is less than "3" (less than three times the amount of first reflection light). The reason why the reflectance of recycled paper is lower than those of plain paper and coated paper is that a surface of the recycled paper is uneven and not smooth compared with surfaces of the plain paper and the coated paper. In addition, that is because the recycled paper has whiteness lower than those of the plain paper and coated paper.

The plain paper, coated paper, and recycled paper each have a reflectance decreasing as the transmittance increases. The reflectance threshold 128 is set to have a value reduced in reflectance as transmittance increases and is stored in the storage. The reason why the reflectance decreases as the transmittance increases is that, when the transmittance of the recording material S increases, emission light emitted from the third light source to the recording material S is transmitted through the recording material S without being reflected therefrom.

When the reflectance is less than a value of the reflectance threshold 128, the control device 101 determines that the type of the recording material S is recycled paper. Furthermore, when a the reflectance is equal to or more than a value of the reflectance threshold 128, the control device 101 determines that the type of the recording material S is either plain paper or coated paper other than recycled paper. The image forming apparatus 100 can accurately determine the type of the recording material S, between recycled paper and the other based, on the basis of a difference in basis weight.

[Process for Acquiring Amount of First Reflection Light]

Figure 19:
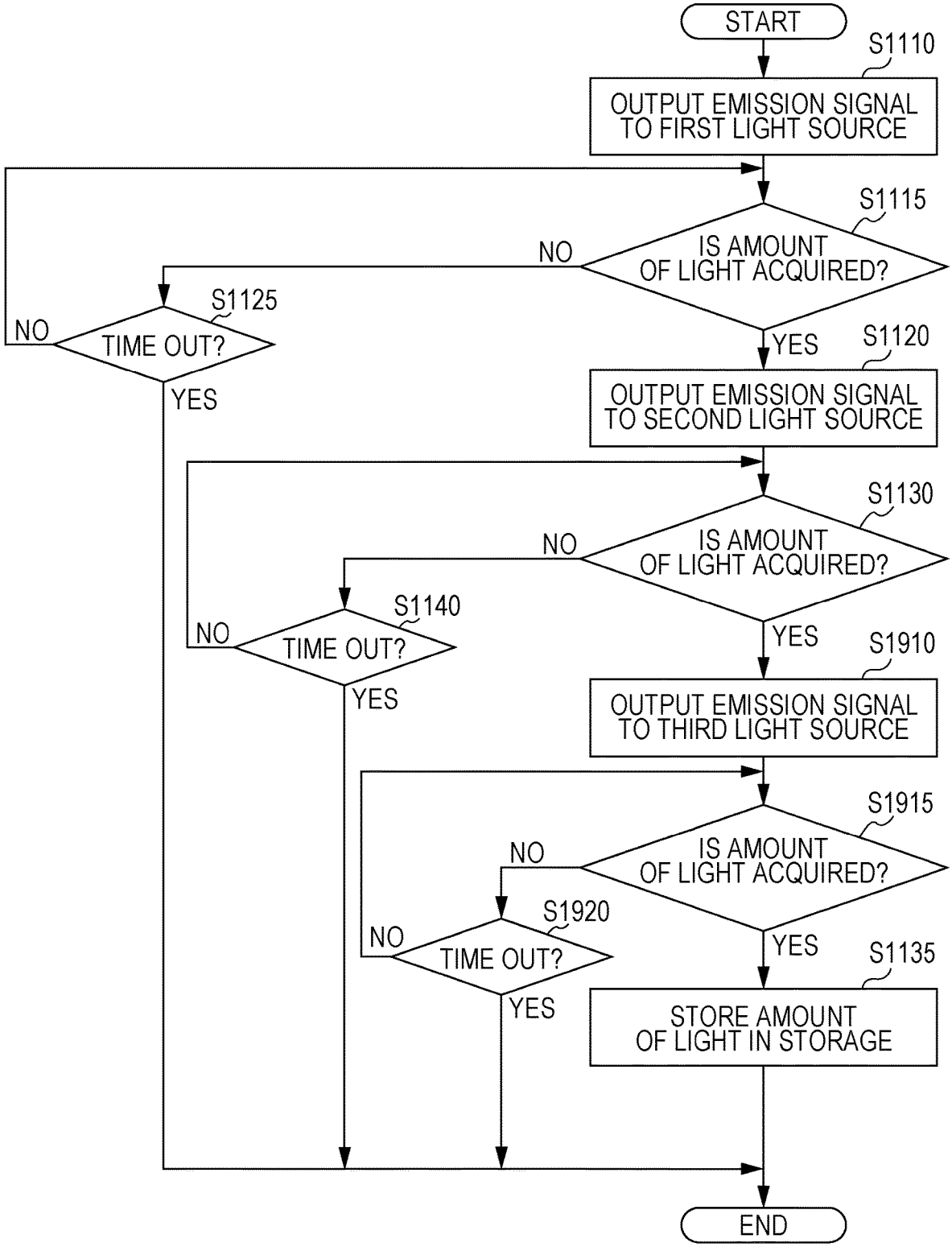
FIG. 19 is a flowchart illustrating a process for acquiring an amount of first reflection light reflected from a reflector by the control device.

FIG. 19 is a flowchart illustrating a process for acquiring an amount of first reflection light reflected from the reflector 93 by the control device 101. The process illustrated in FIG. 19 includes a process for acquiring an amount of first reflection light, in addition to the process illustrated in FIG. 11. More specifically, in the process illustrated in FIG. 19, after step S1130, the control device 101 outputs an instruction signal to the third light source 91*c* in step S1910. The control device 101 outputs the instruction signal to the third light source 91*c* at timing different from timing at which the instruction signal is output to the first light source 91*a* and timing at which the instruction signal is output to the second light source 91*b*.

In step S1915, the control device 101 determines whether an amount of light has been acquired from the optical sensor 92. When receiving the first reflection light obtained when the third emission light 901*c* emitted from the third light source 91*c* is reflected from the reflector 93, the optical sensor 92 outputs the amount of the first reflection light to the control device 101. When determining acquisition of the amount of light from the optical sensor 92 (YES in step S1915), the control device 101 advances the control to step S1135. Otherwise (NO in step S1915), the control device 101 advances the control to step S1920.

In step S1920, the control device 101 measures, by using a timer, a duration of time from a time point at which it is determined whether the amount of the third emission light 901*c* is acquired. Upon timeout (YES in step S1920) after a predetermined period (e.g., one minute), the control device 101 finishes the process of FIG. 19. Otherwise (NO in step S1920), the control device 101 repeatedly performs the control of step S1915.

[Process for Acquiring Amount of Second Reflection Light]

Figure 20:
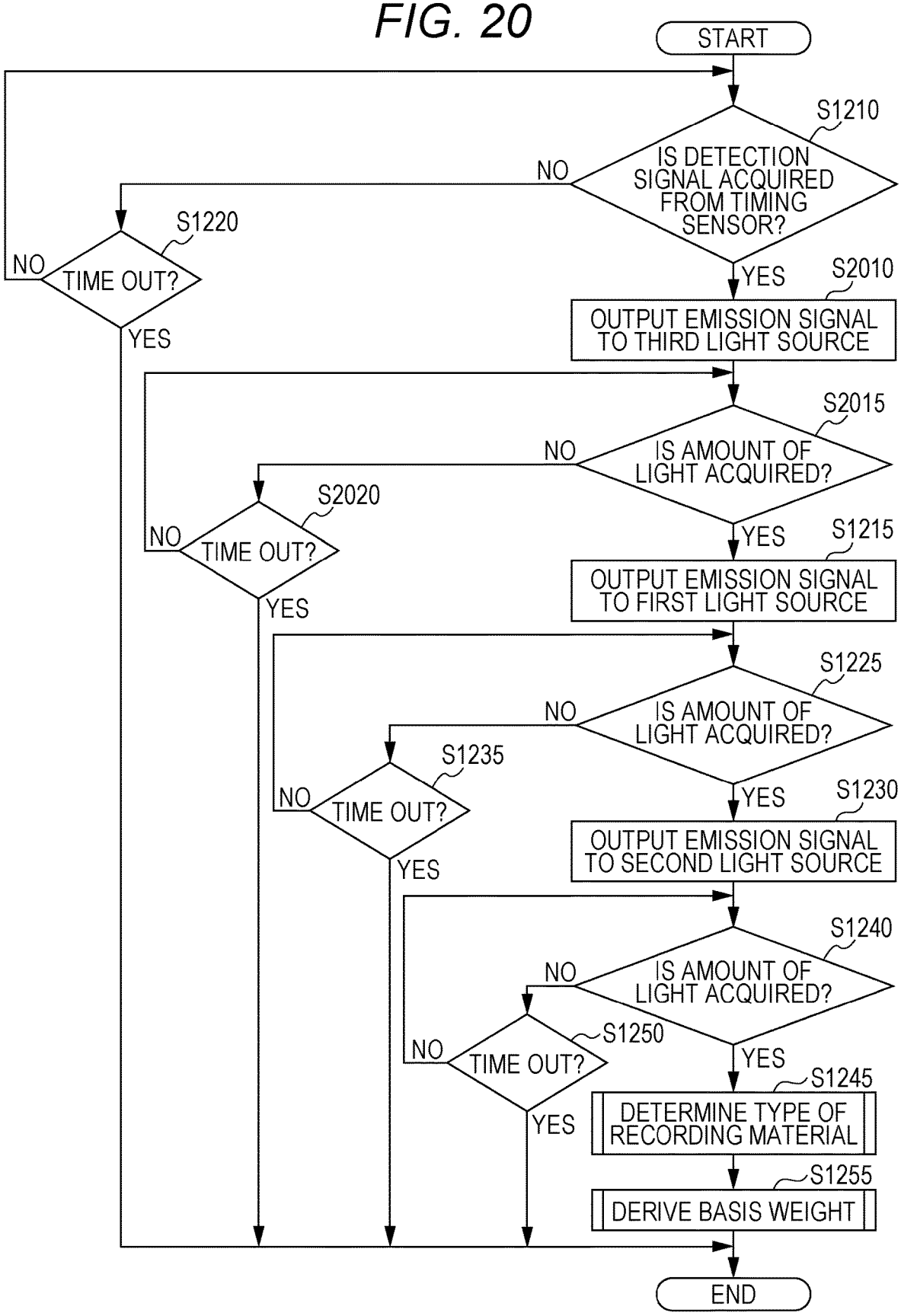
FIG. 20 is a flowchart illustrating a process for acquiring an amount of second reflection light reflected from the recording material by the control device.

FIG. 20 is a flowchart illustrating a process for acquiring an amount of second reflection light reflected from the recording material S by the control device 101. The process illustrated in FIG. 20 includes a process for acquiring an amount of the second reflection light, in addition to the process illustrated in FIG. 12. More specifically, in the process illustrated in FIG. 20, after step S1210, in step S2010, the control device 101 outputs an instruction signal to the third light source 91*c*. The control device 101 outputs the instruction signal to the third light source 91*c* at timing different from timing at which the instruction signal is output to the first light source 91*a* and timing at which the instruction signal is output to the second light source 91*b*.

In step S2015, the control device 101 determines whether an amount of light has been acquired from the optical sensor 92. When receiving the second reflection light obtained when the third emission light 901*c* is reflected from the recording material S, the optical sensor 92 outputs the amount of the second reflection light to the control device 101. When determining acquisition of the amount of light from the optical sensor 92 (YES in step S2015), the control device 101 advances the control to step S1215. Otherwise (NO in step S2015), the control device 101 advances the control to step S2020.

In step S2020, the control device 101 measures, by using a timer, a duration of time from a time point at which it is determined whether the amount of the third emission light 901*c* is acquired. Upon timeout (YES in step S2020) after a predetermined period (e.g., one minute), the control device 101 finishes the process of FIG. 20. Otherwise (NO in step S2020), the control device 101 repeatedly performs the control of step S2015.

[Process for Determining Type of Recording Material S]

Figure 21:
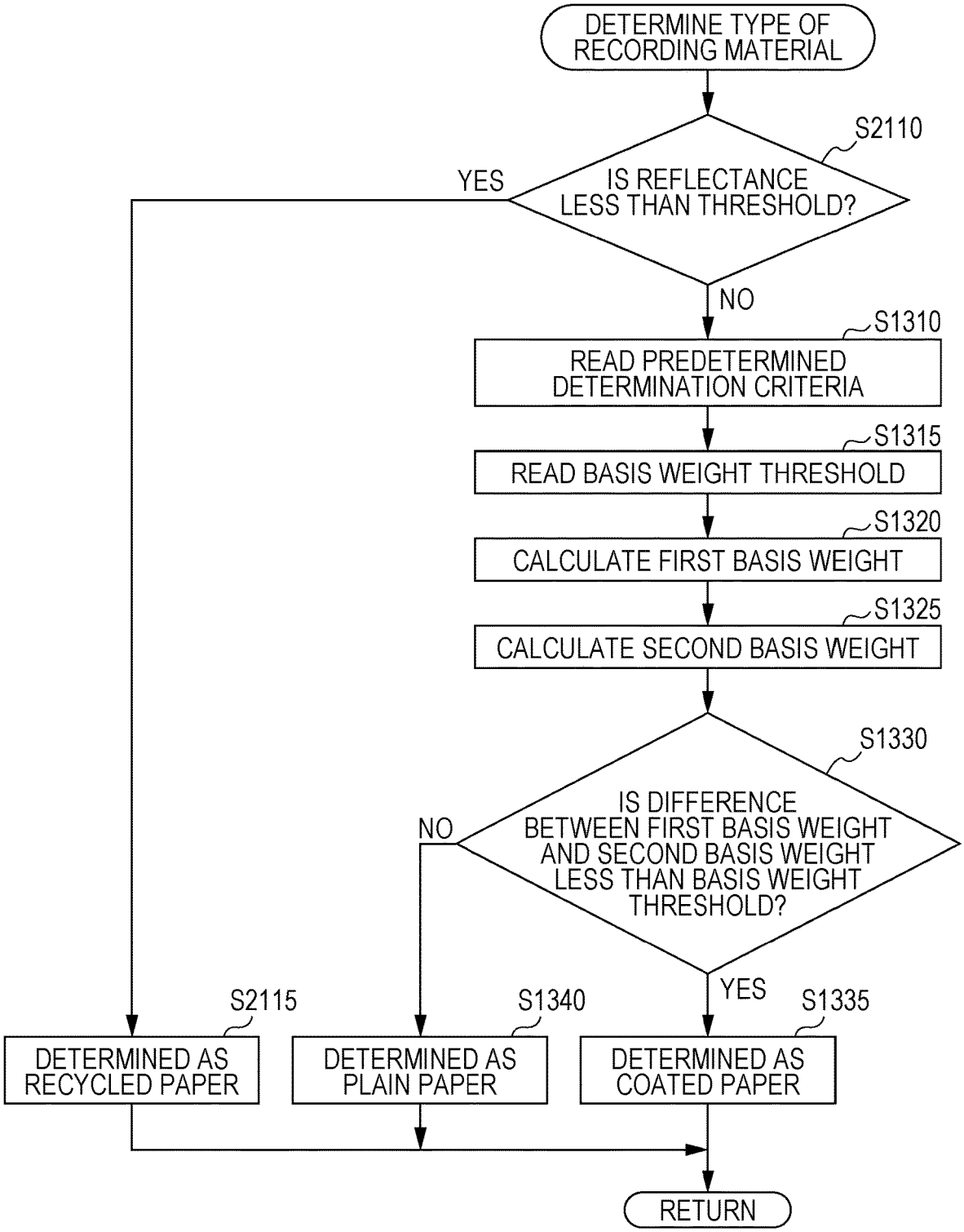
FIG. 21 is a flowchart illustrating a process for determining a type of the recording material by the control de vice according to a second embodiment.

FIG. 21 is a flowchart illustrating a process for determining a type of the recording material S by the control device 101 according to the second embodiment. The process illustrated in FIG. 21 includes a process for determining whether the recording material S is recycled paper on the basis of reflectance, in addition to the process illustrated in FIG. 13. More specifically, in the process illustrated in FIG. 21, before the processing of step S1310, in step S2110, the control device 101 determines whether reflectance has a value less than a value of the reflectance threshold 128.

When the reflectance is less than the reflectance threshold 128 (YES in step S2110), the control is advanced to step S2115. Otherwise (NO in step S2110), the control device 101 advances the control to step S1310.

In step S2115, the control device 101 determines that the type of the recording material S is recycled paper. The image forming apparatus 100 can accurately determine whether the recording material S is recycled paper or other, on the basis of reflectance.

[Process for Driving Basis Weight of Recording Material S]

Figure 22:
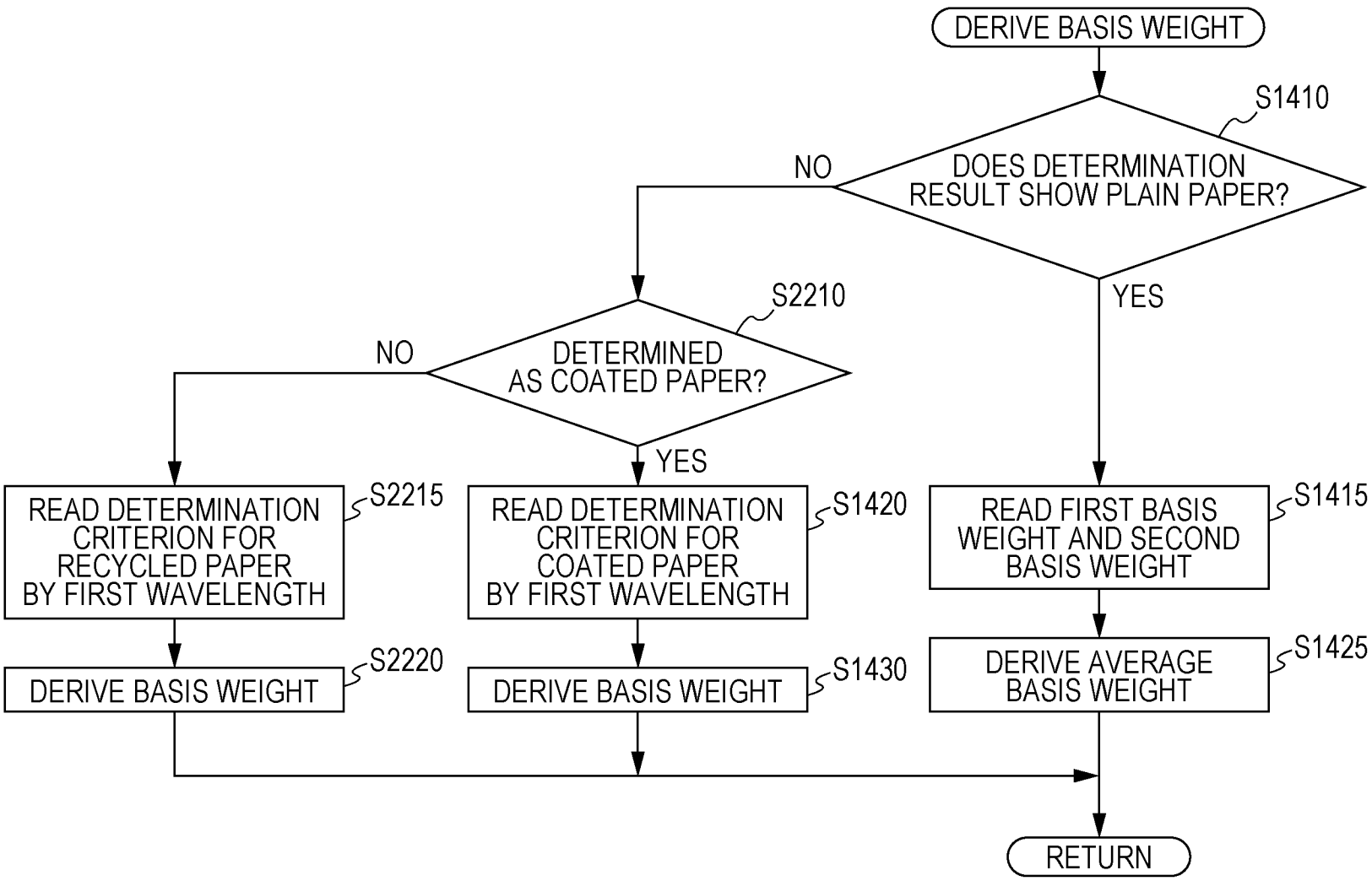
FIG. 22 is a flowchart illustrating a process for deriving a basis weight of the recording material by the control device according to the second embodiment.

FIG. 22 is a flowchart illustrating a process for deriving a basis weight of the recording material S by the control device 101 according to the second embodiment. The process illustrated in FIG. 22 includes a process for deriving a basis weight when the recording material S is determined as recycled paper, in addition to the process illustrated in FIG. 14. More specifically, in the process illustrated in FIG. 22, in step S1410, when it is determined that the type of the recording material S is not plain paper (NO in step S1410), the control device 101 advances the control to step S2210.

In step S2210, the control device 101 determines whether the type of the recording material S is coated paper. When the type of the recording material is coated paper (YES in step S2210), the control device 101 advances the control to step S1420. Otherwise (NO in step S2210), the control device 101 advances the control to step S2215.

In step S2215, the control device 101 reads the determination criterion 613 for recycled paper based on the first wavelength, from the storage.

In step S2220, the control device 101 uses the determination criterion 613 for recycled paper to derive a basis weight corresponding to a first transmittance. The control device 101 sets the derived basis weight to control the temperature or the like of the fuser 50 according to the set basis weight. The image forming apparatus 100 can derive an accurate basis weight according to the type of the recording material S.

Note that when the type of the recording material S is determined as recycled paper, the control device 101 may derive a basis weight obtained by arithmetic mean of a basis weight corresponding to a first transmittance and a basis weight corresponding to a second transmittance so that the basis weight is set as a basis weight of the recording material S for recycled paper.

<Modifications>

In the first and second embodiments, the control device 101 calculates an average basis weight by using arithmetic mean. In contrast, the control device 101 may derive the average basis weight by, for example, averaging other than the arithmetic mean, such as weighted average. The image forming apparatus 100 can select a method of deriving a basis weight.

In the first and second embodiments, when the control device 101 determines the type of the recording material S, the type is automatically set and a basis weight is derived. On the other hand, the type of the recording material S may be set manually by the user. More specifically, the control device 101 may be configured to receive the setting of the type of the recording material S manually input by the user using the image forming apparatus 100 by using the operation panel 130. The image forming apparatus 100 can receive an instruction on printing conditions from the user.

In the first and second embodiments, the amounts of emission light, that is, the amounts of the first emission light 901*a* having a first wavelength and the second emission light 901*b* having a second wavelength are set in advance. On the other land, the control device 101 may adjust the amounts of emission light, that is, the amounts of the first emission light 901*a* and the second emission light 901*b*. For example, when the type of the recording material S to be used is predicted, the control device 101 may increase the amount of emission light according to the type of the recording material S predicted. More specifically, for example, a ratio of the amount of the first emission light 901*a* to the amount of the second emission light 901*b* is set to 2:1. The image forming apparatus 100 can derive a basis weight by using emission light having wavelengths which have a higher correlation with each other.

In the first and second embodiments, the control device 101 determines the type of recording material S as plain paper, coated paper, or recycled paper. On the other hand, the control device 101 may determine, for example, the type of gloss paper or the like. The image forming apparatus 100 can determine the type of the recording material S without limitation.

In the first and second embodiments, the light source 91 emits light, and the control device 101 derives a basis weight. On the other hand, the control device 101 may derive a basis weight by using, for example, an ultrasonic wave or the like, in addition to light. The image forming apparatus 100 can derive a basis weight by using a device other than the light source 91.

In the first and second embodiments, near-infrared light is used for the first emission light 901*a* having a first wavelength (e.g., 750 nm to 900 nm), and blue light included in visible light is used for the second emission light 901*b* having a second wavelength (e.g., 400 nm to 470 nm). As another wavelength other than these wavelengths, for example, emission light of violet light included in the visible light, having a wavelength of 380 nm to 400 nm may be used. For example, emission light of ultraviolet light having a wavelength of 315 nm to 400 nm which is shorter than that of visible light, may be used. The image forming apparatus 100 can derive a basis weight by selecting emission light having a wavelength suitable for calculating a transmittance of the recording material S from emission light having wavelengths which have a high correlation between transmittance and basis weight.

The control device 101 calculates a transmittance from an amount of emission light having another wavelength and an amount of transmission light and derives a basis weight corresponding to the transmittance by using a determination criterion based on the other wavelength. The control device 101 derives an average basis weight obtained by averaging the derived basis weight, the first basis weight, and the second basis weight. The image forming apparatus 100 adds a light source for emitting emission light having a wavelength which has a high correlation between transmittance and basis weight to derive an average basis weight of a basis weight based on the added light source and a basis weight based on another light source, and thus, a more accurate basis weight can be derived.

In the first and second embodiments, the control device 101 firstly derives a first basis weight corresponding to the first transmittance according to the determination criterion 611. Furthermore, the control device 101 derives a second basis weight corresponding to the second transmittance according to the determination criterion 711. Next, the control device 101 derives an average basis weight obtained by arithmetic mean of the first basis weight and the second basis weight. On the other hand, the control device 101 firstly calculates an average transmittance obtained by averaging the first transmittance and the second transmittance.

Next, the control device 101 may derive a basis weight corresponding to the average transmittance by using a determination criterion. The storage 120 stores determination criteria in which average transmittance and basis weight are associated with each other, in the storage 120 in advance. The control device 101 reads a determination criterion having an average transmittance and a basis weight associated with each other and stored in the storage 120 and executes the process for deriving a basis weight. When there is a plurality of methods of deriving a basis weight, the image forming apparatus 100 can select a method of deriving a basis weight by which a processing load upon deriving a basis weight by the control device 101 decreases. The image forming apparatus 100 can derive an accurate basis weight of the recording material S by the selected method.

In the first and second embodiments, the control device 101 calculates a value of a difference between the first basis weight and the second basis weight to determine the type of the recording material S by using the basis weight threshold 126. On the other hand, the control device 101 may determine the type of the recording material on the basis of, for example, a ratio between the first basis weight and the second basis weight, in addition to the difference between the first basis weight and the second basis weight. When deriving a basis weight, the image forming apparatus 100 can select a process for deriving a basis weight with a smaller calculation load.

Although embodiments of the present invention have been described and illustrated in detail, the disclosed embodiments are made for purposes of illustration and example only and not limitation. The scope of the present invention should be interpreted by terms of the appended claims rather than the foregoing description, and all changes which come within the meaning and range of equivalents thereof are intended to be embraced therein.

What is claimed is:

1. An image forming apparatus comprising:

a first light source that emits first emission light having a first wavelength toward a paper feed path for transporting a recording material in the image forming apparatus;

a second light source that emits, toward the paper feed path, second emission light having a second wavelength different in length from the first wavelength;

an optical sensor that detects an amount of the first emission light and an amount of the second emission light, an amount of first transmission light obtained when the first emission light is transmitted through the recording material, and an amount of second transmission light obtained when the second emission light is transmitted through the recording material;

a storage that stores a plurality of determination criteria each representing a correspondence of a transmittance calculated from an amount of emission light and an amount of transmission light with a basis weight indicating a weight per unit area of the recording material; and a hardware processor that controls operation of the image forming apparatus, wherein the storage stores a first threshold for determining a type of the recording material based on the basis weight, and the hardware processor:

calculates a first transmittance from the mount of the first emission light and the amount of the first transmission light;

calculates a second transmittance from the amount of the second emission light and the amount of the second transmission light;

derives a first basis weight corresponding to the first transmittance and a second basis weight corresponding to the second transmittance, by using predetermined determination criteria of the plurality of determination criteria;

determines the type of the recording material based on a value of a difference between the first basis weight and the second basis weight by using the first threshold; and derives the basis weight according to the determination criteria based on the determined type of the recording material.

2. The image forming apparatus according to claim 1, wherein the hardware processor determines that the recording material is a first type, when the value of the difference between the first basis weight and the second basis weight is equal to or larger than the first threshold, and determines that the recording material is a second type, when the value of the difference is less than the first threshold.

3. The image forming apparatus according to claim 1, further comprising:

a third light source that emits, toward the paper feed path, third emission light having a third wavelength different in length from the first wavelength and the second wavelength; and a reflector provided in the paper feed path to reflect the third emission light, wherein the optical sensor detects an amount of first reflection light obtained when the third emission light is reflected from the reflector, and an amount of second reflection light obtained when the third emission light is reflected from the recording material, the storage stores a second threshold for determining the type of the recording material based on a reflectance calculated from an amount of reflection light, and the hardware processor:

calculates the reflectance from the amount of first reflection light and the amount of second reflection light; and determines the type of the recording material based on the reflectance, by using the second threshold.

4. The image forming apparatus according to claim 3, wherein the hardware processor determines that the recording material is a first type, when the value of the difference between the first basis weight and the second basis weight is equal to or larger than the first threshold, determines that the recording material is a second type, when the value of the difference is less than the first threshold, determines that the recording material is either the first type or the second type, when the reflectance is equal to or larger than the second threshold, and determines that the recording material is a third type, when the reflectance is less than the second threshold.

5. The image forming apparatus according to claim 3, wherein the first wavelength includes a wavelength of 750 nm to 900 nm, the second wavelength includes a wavelength of 400 nm to 470 nm, and the third wavelength includes a wavelength of 495 nm to 570 nm.

6. A basis-weight deriving method, the method being performed by an image forming apparatus, the method comprising:

calculating a first transmittance based on an amount of first emission light obtained when the first emission light having a first wavelength is emitted toward a paper feed path for transporting a recording material in the image forming apparatus, and an amount of first transmission light obtained when the first emission light is transmitted through the recording material;

calculating a second transmittance based on an amount of second emission light obtained when the second emission light, which has a second wavelength different in length from the first wavelength, is emitted toward the paper feed path, and an amount of second transmission light obtained when the second emission light is transmitted through the recording material;

deriving a first basis weight corresponding to the first transmittance and a second basis weight corresponding to the second transmittance, by using predetermined determination criteria of a plurality of determination criteria each representing a correspondence of transmittance calculated based on an amount of emission light and an amount of transmission light with a basis weight indicating a weight per unit area of the recording material;

determining a type of the recording material based on a value of a difference between the first basis weight and the second basis weight, by using a first threshold for determining the type of the recording material based on the basis weight; and deriving the basis weight according to the determination criteria based on the determined type of the recording material.

7. The basis-weight deriving method according to claim 6, wherein in the determining the type of the recording material, when the value of the difference between the first basis weight and the second basis weight is equal to or larger than the first threshold, the recording material is determined as a first type, and when the value of the difference is less than the first threshold, the recording material is determined as a second type.

8. The basis-weight deriving method according to claim 6, further comprising calculating a reflectance from an amount of first reflection light obtained when third emission light having a third wavelength different in length from the first wavelength and the second wavelength is reflected, toward the paper feed path, from a reflector provided in the paper feed path to reflect the third emission light, and an amount of second reflection light obtained when the third emission light is reflected from the recording material, wherein in the determining the type of the recording material, a second threshold for determining a type of the recording material based on the reflectance is used to determine the type of the recording material based on the reflectance.

9. The basis-weight deriving method according to claim 8, wherein:

in the determining the type of the recording material, when the value of the difference between the first basis weight and the second basis weight is equal to or larger than the first threshold, the recording material is determined as a first type, and when the value of the difference is less than the first threshold, the recording material is determined as a second type; and in the determining the type of the recording material, when the reflectance is equal to or larger than the second threshold, the recording material is determined as any of the first type and the second type, and when the reflectance is less than the second threshold, the recording material is determined as a third type.

10. The basis-weight deriving method according to claim 8, wherein the first wavelength includes a wavelength of 750 nm to 900 nm, the second wavelength includes a wavelength of 400 nm to 470 nm, and the third wavelength includes a wavelength of 495 nm to 570 nm.

11. A non-transitory recording medium storing a computer readable basis weight-deriving program for an image forming apparatus, the basis weight-deriving program causing a hardware processor that controls an operation of the image forming apparatus to execute:

calculating a first transmittance based on an amount of first emission light obtained when the first emission light having a first wavelength is emitted toward a paper feed path for transporting a recording material in the image forming apparatus, and an amount of first transmission light obtained when the first emission light is transmitted through the recording material;

calculating a second transmittance based on an amount of second emission light obtained when the second emission light, which has a second wavelength different in length from the first wavelength, is emitted toward the paper feed path, and an amount of second transmission light obtained when the second emission light is transmitted through the recording material;

deriving a first basis weight corresponding to the first transmittance and a second basis weight corresponding to the second transmittance, by using predetermined determination criteria of a plurality of determination criteria each representing a correspondence of transmittance calculated based on an amount of emission light and an amount of transmission light with a basis weight indicating a weight per unit area of the recording material;

determining a type of the recording material based on a value of a difference between the first basis weight and the second basis weight, by using a first threshold for determining the type of the recording material based on the basis weight; and deriving the basis weight according to the determination criteria based on the determined type of the recording material.

12. The non-transitory recording medium storing a computer readable basis weight-deriving program according to claim 11, wherein in the determining the type of the recording material, when the value of the difference between the first basis weight and the second basis weight is equal to or larger than the first threshold, the recording material is determined as a first type, and when the value of the difference is less than the first threshold, the recording material is determined as a second type.

13. The non-transitory recording medium storing a computer readable basis weight-deriving program according to claim 11, further comprising calculating a reflectance from an amount of first reflection light obtained when third emission light having a third wavelength different in length from the first wavelength and the second wavelength is reflected, toward the paper feed path, from a reflector provided in the paper feed path to reflect the third emission light, and an amount of second reflection light obtained when the third emission light is reflected from the recording material, wherein in the determining the type of the recording material, a second threshold for determining a type of the recording material based on the reflectance is used to determine the type of the recording material based on the reflectance.

14. The non-transitory recording medium storing a computer readable basis weight-deriving program according to claim 13, wherein:

in the determining the type of the recording material, when the value of the difference between the first basis weight and the second basis weight is equal to or larger than the first threshold, the recording material is determined as a first type, and when the value of the difference is less than the first threshold, the recording material is determined as a second type; and in the determining the type of the recording material, when the reflectance is equal to or larger than the second threshold, the recording material is determined as any of the first type and the second type, and when the reflectance is less than the second threshold, the recording material is determined as a third type.

15. The non-transitory recording medium storing a computer readable basis weight-deriving program according to claim 13, wherein the first wavelength includes a wavelength of 750 nm to 900 nm, the second wavelength includes a wavelength of 400 nm to 470 nm, and the third wavelength includes a wavelength of 495 nm to 570 nm.

* * * * *